US010935051B2

(12) United States Patent
Yokoyama et al.

(10) Patent No.: US 10,935,051 B2
(45) Date of Patent: Mar. 2, 2021

(54) EJECTOR AND EJECTOR-TYPE REFRIGERATION CYCLE

(71) Applicant: DENSO CORPORATION, Kariya (JP)

(72) Inventors: Yoshiyuki Yokoyama, Kariya (JP); Haruyuki Nishijima, Kariya (JP); Yoshiaki Takano, Kariya (JP)

(73) Assignee: DENSO CORPORATION, Kariya (JP)

( * ) Notice: Subject to any disclaimer, the term of this patent is extended or adjusted under 35 U.S.C. 154(b) by 198 days.

(21) Appl. No.: 15/554,249

(22) PCT Filed: Feb. 26, 2016

(86) PCT No.: PCT/JP2016/001050

§ 371 (c)(1),
(2) Date: Aug. 29, 2017

(87) PCT Pub. No.: WO2016/143291

PCT Pub. Date: Sep. 15, 2016

(65) Prior Publication Data

US 2018/0080482 A1 Mar. 22, 2018

(30) Foreign Application Priority Data

Mar. 9, 2015 (JP) ..... JP2015-045871

(51) Int. Cl.
*F04F 5/46* (2006.01)
*F04F 5/50* (2006.01)
(Continued)

(52) U.S. Cl.
CPC ..... *F04F 5/461* (2013.01); *F04F 5/18* (2013.01); *F04F 5/44* (2013.01); *F04F 5/46* (2013.01);
(Continued)

(58) Field of Classification Search
CPC ..... F04F 5/461; F04F 5/18; F04F 5/44; F04F 5/46; F04F 5/50; F25B 1/00; F25B 41/00;
(Continued)

(56) References Cited

U.S. PATENT DOCUMENTS 3,836,080 A * 9/1974 Butterfield ..... F02M 61/18 239/96
2004/0007013 A1* 1/2004 Takeuchi ..... F04F 5/461 62/500
(Continued)

FOREIGN PATENT DOCUMENTS

CN 1673648 A1 9/2005
JP 2012202653 A 10/2012
(Continued)

OTHER PUBLICATIONS

English Translation of WO 2013/114856 (Yamada) obtained Jul. 3, 2019 (Year: 2019).*

*Primary Examiner* — Connor J Tremarche
(74) *Attorney, Agent, or Firm* — Harness, Dickey & Pierce, P.L.C.

(57) ABSTRACT

An ejector includes a nozzle, a body including a refrigerant suction port and a pressure increasing portion, a passage forming member inserted into the nozzle, and an actuation device moving the passage forming member. A nozzle passage includes a smallest passage cross-sectional area portion, a convergent portion, and a divergent portion. The passage forming member includes a tip portion which changes the passage cross-sectional area at the smallest passage cross-sectional area portion when the actuation device moves the passage forming member. A positive displacement amount is defined as an amount of a displacement of the passage forming member when the passage forming member is moved so as to increase the passage cross-sectional area at the smallest passage cross-sectional
(Continued)

area portion. The tip portion has a shape in which an increase rate of the smallest passage cross-sectional area portion is increased according to an increase of the positive displacement amount.

3 Claims, 8 Drawing Sheets

(51) Int. Cl.

| | |
|---|---|
| ***F04F 5/18*** | (2006.01) |
| ***F25B 1/00*** | (2006.01) |
| ***F25B 41/06*** | (2006.01) |
| ***F04F 5/44*** | (2006.01) |
| ***F25B 41/00*** | (2021.01) |

(52) U.S. Cl.
CPC ..... *F04F 5/50* (2013.01); *F25B 1/00* (2013.01); *F25B 41/00* (2013.01); *F25B 41/06* (2013.01); *F25B 2341/0012* (2013.01); *F25B 2400/23* (2013.01); *F25B 2500/18* (2013.01)

(58) Field of Classification Search
CPC ..... F25B 41/06; F25B 2341/0012; F25B 2400/23; F25B 2500/18
USPC ..... 417/54
See application file for complete search history.

(56) References Cited

U.S. PATENT DOCUMENTS

| | | | | |
|---|---|---|---|---|
| 2004/0074994 | A1* | 4/2004 | Ganzer | B05C 5/0225 239/533.1 |
| 2004/0172966 | A1* | 9/2004 | Ozaki | F04F 5/04 62/500 |
| 2005/0204771 | A1 | 9/2005 | Ogata et al. | |
| 2010/0297518 | A1* | 11/2010 | Wake | H01M 8/04097 429/443 |
| 2014/0020424 | A1 | 1/2014 | Suzuki et al. | |
| 2015/0023809 | A1 | 1/2015 | Yamada et al. | |
| 2015/0033790 | A1 | 2/2015 | Yamada et al. | |
| 2015/0176606 | A1 | 6/2015 | Yamada et al. | |

FOREIGN PATENT DOCUMENTS

| | | | | |
|---|---|---|---|---|
| JP | 2013177879 | A | 9/2013 | |
| JP | 2013185485 | A | 9/2013 | |
| WO | WO-2013114856 | A1 * | 8/2013 | F04F 5/462 |
| WO | WO-2014010162 | A1 | 1/2014 | |
| WO | WO-2016143300 | A1 | 9/2016 | |

* cited by examiner

DURING MIDDLE-LOAD OPERATION AND LOW-LOAD OPERATION

DURING HIGH-LOAD OPERATION

EJECTOR AND EJECTOR-TYPE REFRIGERATION CYCLE

CROSS REFERENCE TO RELATED APPLICATIONS

This application is a U.S. National Phase Application under 35 U.S.C. 371 of International Application No. PCT/JP2016/001050 filed on Feb. 26, 2016 and published in Japanese as WO 2016/143291 A1 on Sep. 15, 2016. This application is based on and claims the benefit of priority from Japanese Patent Application No. 2015-045871 filed on Mar. 9, 2015. The entire disclosures of all of the above applications are incorporated herein by reference.

TECHNICAL FIELD

The present disclosure relates to an ejector that draws a fluid by a drawing effect of a jetted fluid jetted at high velocity, and an ejector-type refrigeration cycle that includes the ejector.

BACKGROUND ART

Conventionally, Patent Document 1 discloses an ejector that draws a refrigerant through a refrigerant suction port by a drawing effect of a jetted refrigerant jetted at high velocity, the jetted refrigerant and the drawn refrigerant being mixed, a pressure of the mixed refrigerant being increased in the ejector. Patent Document 1 discloses an ejector-type refrigeration cycle that is a vapor-compression-type refrigeration cycle device including the ejector as a refrigerant decompression device.

In the ejector of Patent Document 1, a passage forming member having a circular cone shape is provided in a body, and a refrigerant passage is defined between the body and a circular cone-shaped side surface of the passage forming member. A cross-sectional shape of the refrigerant passage is a circular annular shape. The most upstream part of the refrigerant passage is used as a nozzle passage through which a high-pressure refrigerant is decompressed and ejected, and the most downstream part of the refrigerant passage is used as a diffuser passage in which the jetted refrigerant and the drawn refrigerant are mixed, a pressure of the mixed refrigerant being increased in the diffuser passage.

Moreover a swirl space, which is a swirl flow generation portion generating a swirl flow in the refrigerant flowing into the nozzle passage, is defined in the body of the ejector of Patent Document 1. In the swirl space, the refrigerant on a swirl center side is decompressed and boiled by being swirled the subcooled liquid-phase refrigerant about a center axis of the nozzle, and a gas-phase refrigerant (air column) having a column shape is generated on the swirl center side. The two-phase separated refrigerant on the swirl center side flows into the nozzle passage.

According to this, in the ejector of Patent Document 1, boiling of the refrigerant flowing through the nozzle passage is enhanced by using, as a boiling core, an air bubble generated on an interface between the gas-phase refrigerant and the liquid-phase refrigerant of the two-phase separated refrigerant, and an efficiency of energy conversion when converting a pressure energy to a kinetic energy in the nozzle passage is intended to be improved.

Moreover, the ejector of Patent Document 1 includes an actuation device that changes a passage cross-sectional area of a refrigerant passage defined between the body and the passage forming member by moving the passage forming member. Therefore, the ejector of Patent Document 1 is intended to be actuated adequately according to the amount of the refrigerant circulating in the cycle by changing the passage cross-sectional area of the refrigerant passage according to a change of a load of the ejector-type refrigeration cycle.

PRIOR ART DOCUMENT

Patent Document

Patent Document 1: JP No. 2013-177879 A

SUMMARY OF THE INVENTION

According to studies by the inventors of the present disclosure, in the ejector-type refrigeration cycle of Patent Document 1, the amount of the refrigerant circulating in the cycle may be smaller than a preferable amount even though the actuation device moves the passage forming member during a high-load operation of the cycle to enlarge the passage cross-sectional area of the refrigerant passage.

The inventors of the present disclosure has studied about the causes, and it is found that the column shape of the air column formed in the swirl space is distorted when the amount of the circulating refrigerant is changed due to the change of the load of the cycle. This is because the shapes of the swirl space and a refrigerant flow-in passage through which the refrigerant flowing into the swirl space are fixed.

In detail, since a swirling speed of the refrigerant swirling in the swirl space increases during the high-load operation in which the amount of the circulating refrigerant increases, a diameter of the air column formed in the swirl space is increased. Accordingly, during the high-load operation, an inner side area of a smallest passage cross-sectional area portion of the nozzle passage into which the gas-phase refrigerant having a low density flows is likely to be large, and an outer side area into which the liquid-phase refrigerant having a high density flows is likely to be small.

Accordingly, in the ejector of Patent Document 1, a pressure loss occurring when the refrigerant flows through the smallest passage cross-sectional area portion increases even when the actuation device enlarges the passage cross-sectional area of the smallest passage cross-sectional area portion by moving the passage forming member having a circular cone shape, and accordingly a coefficient of discharge of the nozzle passage may be likely to decrease. Consequently, in the ejector-type refrigeration cycle of Patent Document 1, the amount of the circulating refrigerant may be smaller than the preferable amount during the high-load operation.

It may be considered to limit the decrease of the coefficient of discharge during the high-load operation by enlarging a diameter of a throat portion of the nozzle defining the smallest passage cross-sectional area portion. However, in such case, a proportion of the liquid-phase refrigerant to the refrigerant flowing in the nozzle passage is increased during the low-load operation, and accordingly the boiling core may become insufficient and the refrigerant may not be boiled sufficiently.

In consideration of the above-described points, it is an objective of the present disclosure to limit a decrease of an coefficient of discharge in an ejector that generates a swirl flow in a refrigerant flowing into a nozzle.

Moreover, it is another objective of the present disclosure to provide an ejector-type refrigeration cycle that is capable of limiting the decrease of the coefficient of discharge even when a load of a cycle is changed.

An ejector according to an aspect of the present disclosure is used in a vapor-compression type refrigeration cycle device and includes: a nozzle that ejects a refrigerant; a swirl flow generation portion that generates a swirl flow about a center axis of the nozzle in the refrigerant flowing into the nozzle; a body including a refrigerant suction port through which the refrigerant is drawn from an outside by a drawing effect of the ejected refrigerant ejected from the nozzle, and a pressure increasing portion in which the ejected refrigerant and the drawn refrigerant drawn through the refrigerant suction port are mixed, a pressure of the mixed refrigerant is increased in the pressure increasing portion; a passage forming member that is inserted into a refrigerant passage defined in the nozzle; and an actuation device that moves the passage forming member. The refrigerant passage defined between an inner peripheral surface of the nozzle and an outer peripheral surface of the passage forming member is a nozzle passage decompressing the refrigerant. The nozzle passage includes: a smallest passage cross-sectional area portion at which a passage cross-sectional area is decreased the most; a convergent portion that is located upstream of the smallest passage cross-sectional area portion with respect to a refrigerant flow, the passage cross-sectional area being gradually decreased in the smallest passage cross-sectional area portion; and a divergent portion located downstream of the smallest passage cross-sectional area portion with respect to the refrigerant flow, the passage cross-sectional area is gradually increased in the divergent portion. A part of the passage forming member that changes the passage cross-sectional area at the smallest passage cross-sectional area portion during the actuation device moving the passage forming member is a tip portion. The amount of displacement of the passage forming member in a direction in which the passage forming member increases the passage cross-sectional area at the smallest passage cross-sectional area portion is a positive displacement amount. The tip portion has a shape in which an increase rate of the passage cross-sectional area at the smallest passage cross-sectional area portion is increased according to an increase of the positive displacement amount.

According to this, the passage cross-sectional area of the smallest passage cross-sectional area portion can be increased when the positive displacement amount is increased compared to a case where the passage cross-sectional area of the smallest passage cross-sectional area portion is increased in proportion to the increase of the positive displacement amount. Accordingly, the passage cross-sectional area of the smallest passage cross-sectional area portion can be enlarged sufficiently by increasing the positive displacement amount during the high-load operation in which the circulating refrigerant amount is increased.

Consequently, an increase of a pressure loss occurring when the refrigerant flowing through the nozzle passage during the high-load operation can be limited, and a large decrease of a coefficient of discharge during the high-load operation can be limited even in the ejector that generates the swirl flow in the refrigerant flowing into the nozzle.

Moreover, in the ejector having the above-described features, it is preferable that an increase rate of the passage cross-sectional area of the smallest passage cross-sectional area portion increases according to an increase of the amount of the refrigerant flowing through the nozzle passage. According to this, the passage cross-sectional area of the smallest passage cross-sectional area portion during the high-load operation can be easily increased to be equal or above the passage cross-sectional area required to limit the decrease of the coefficient of discharge.

Moreover, in the ejector having the above-described features, a specific shape of the tip portion may be a shape of a solid of revolution in which a sectional area taken in a direction perpendicular to an axial direction gradually increases toward a downstream side of the refrigerant flow. Moreover, a sectional shape of a cross-section including a center axis of the tip portion may be a shape in which an increase rate of a distance from the center line to the tip portion is decreased from a tip of the tip portion.

According to another aspect of the present embodiment, an ejector-type refrigeration cycle includes the above-described ejector, and a radiator that cools a high-pressure refrigerant discharged from a compressor compressing the refrigerant, the high-pressure refrigerant is cooled to become a subcooled liquid-phase refrigerant in the radiator. The subcooled liquid-phase refrigerant flows into the swirl flow generation portion.

According to this, the ejector-type refrigeration cycle including the ejector, which is capable of limiting the decrease of the coefficient of discharge even when the load of cycle is changed, can be provided.

EMBODIMENTS FOR EXPLOITATION OF THE INVENTION

Figure 1:
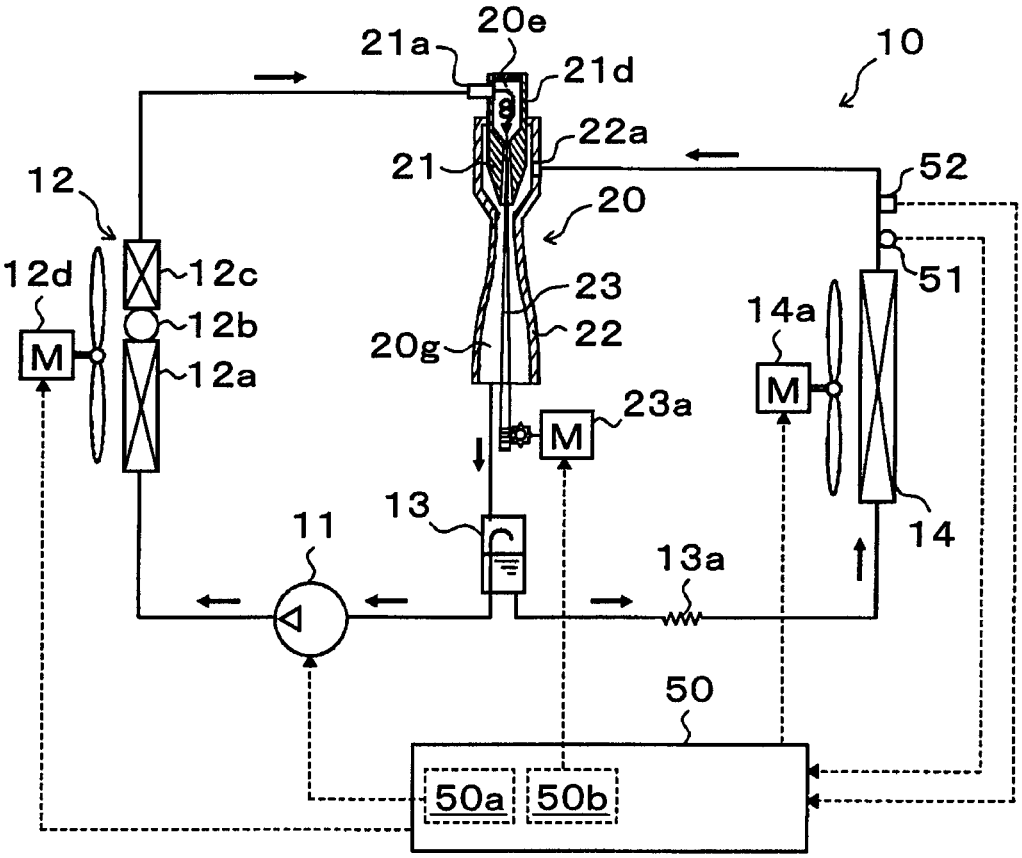
FIG. 1 is a diagram illustrating an entire structure of an ejector-type refrigeration cycle according to a first embodiment.
Figure 2:
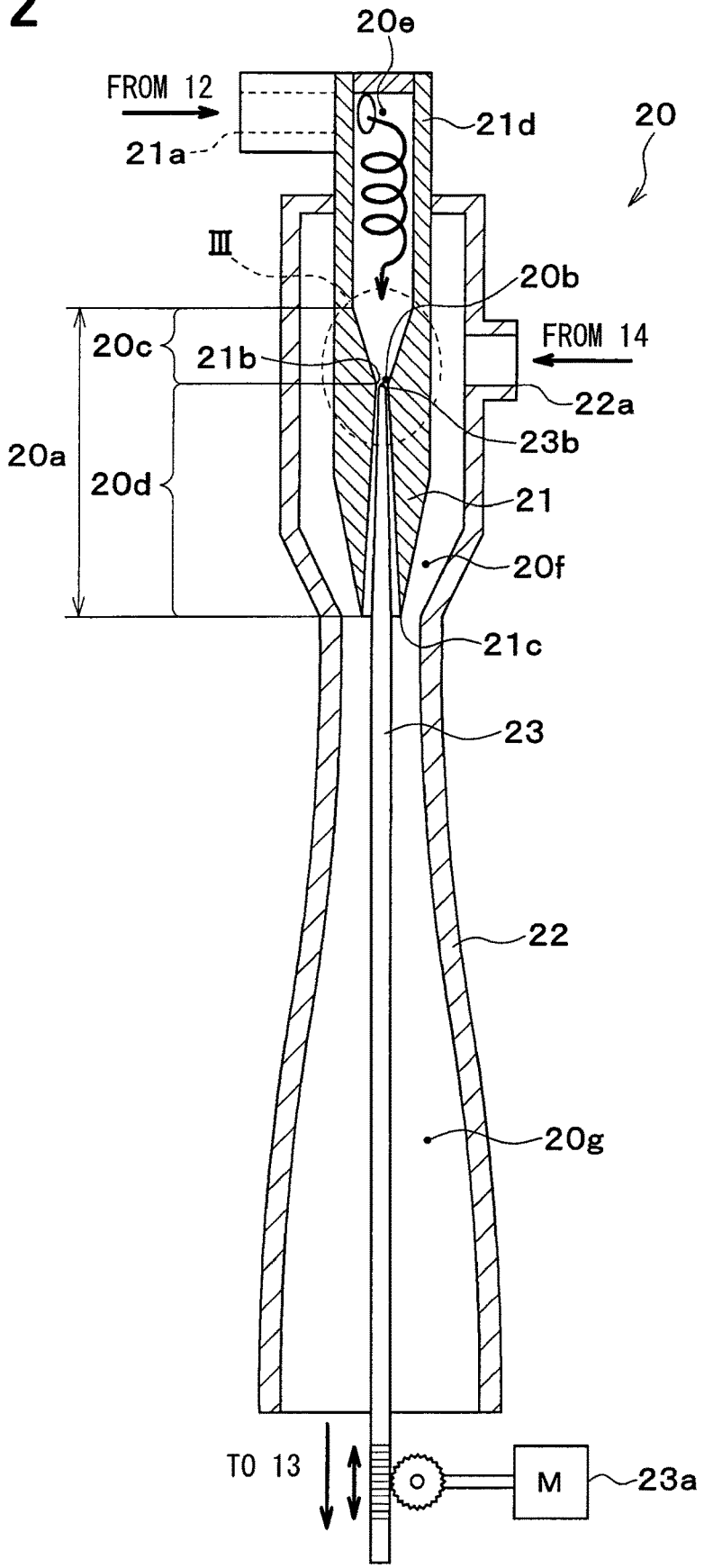
FIG. 2 is a sectional diagram of an ejector taken along an axial direction according to the first embodiment.

Hereinafter, multiple embodiments for implementing the present invention will be described referring to drawings. In the respective embodiments, a part that corresponds to a matter described in a preceding embodiment may be assigned the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

A first embodiment of the present disclosure will be described below referring FIGS. 1 to 8. An ejector 20 of the present embodiment is used in a vapor-compression-type refrigeration cycle device including the ejector, i.e. an ejector-type refrigeration cycle 10, as shown in FIG. 1 illustrating an entire structure. Moreover, the ejector-type refrigeration cycle 10 is used in a vehicular air conditioning device and cools a blown air sent to a vehicle compartment that is an air conditioning target space. Accordingly, a cooling target fluid of the ejector-type refrigeration cycle 10 of the present embodiment is the blown air.

Moreover, in the ejector-type refrigeration cycle 10 of the present embodiment, HFC refrigerant (specifically, R134a) is used, and the ejector-type refrigeration cycle 10 constitutes a subcritical refrigeration cycle in which a refrigerant pressure on a high-pressure side does not excess a critical pressure of the refrigerant. It is needless to say that HFO refrigerant (specifically, R1234yf) may be employed as the refrigerant. Moreover, a refrigeration oil that supplies lubrication to a compressor 11 is mixed to the refrigerant, and a part of the refrigeration oil circulates in the cycle together with the refrigerant.

In the ejector-type refrigeration cycle 10, the compressor 11 draws the refrigerant, increases a pressure of the refrigerant such that the refrigerant becomes a high-pressure refrigerant, and discharges the high-pressure refrigerant. Specifically, the compressor 11 of the present embodiment is an electric compressor that accommodates a fixed-capacity-type compression device and an electric motor driving the compression device in one housing.

A variety of compression devices such as a scroll-type compression device or a bane-type compression device can be used as the compression device. An actuation (a rotation speed) of the electric motor is controlled by a control signal outputted from an air conditioning control unit 50, and either an alternating-current motor or a direct-current motor can be used as the electric motor.

A refrigerant inlet side of a condensing portion 12*a* of a radiator 12 is connected to a discharge port of the compressor 11. The radiator 12 is a heat dissipation heat exchanger that dissipates heat from the high-pressure refrigerant to cool the high-pressure refrigerant by performing a heat exchange between the high-pressure refrigerant discharged from the compressor 11 and a vehicle outside air (outside air) blown by a cooling fan 12*d*.

More specifically, the radiator 12 is a so-called subcooling-type condenser including the condensing portion 12*a*, a receiver portion 12*b*, and a subcooling portion 12*c*. The condensing portion 12*a* dissipates the heat from the high-pressure gas-phase refrigerant to condense the high-pressure gas-phase refrigerant by performing the heat exchange between the high-pressure gas-phase refrigerant and the outside air blown by the cooling fan 12*d*. The receiver portion 12*b* separates the refrigerant flowing out of the condensing portion 12*a* into the gas-phase refrigerant and the liquid-phase refrigerant and accumulates a surplus liquid-phase refrigerant. The subcooling portion 12*c* performs heat exchange between the liquid-phase refrigerant flowing out of the receiver portion 12*b* and the outside air blown by the cooling fan 12*d* to subcool the liquid-phase refrigerant.

The cooling fan 12*d* is an electric blower whose rotation speed (the amount of blowing air) is controlled by a control voltage outputted from the air conditioning control unit 50.

A refrigerant flow inlet 21*a* of the ejector 20 is connected to a refrigerant outlet of the subcooling portion 12*c* of the radiator 12. The ejector 20 works as a refrigerant decompression device that decompresses the high-pressure liquid-phase refrigerant in a subcooled state flowing out of the radiator 12 and ejects the refrigerant to a downstream side, and the ejector 20 works as a refrigerant circulation device (refrigerant sending device) that draws (send) the refrigerant flowing out of an evaporator by a drawing effect of a jetted refrigerant jetted at a high velocity and circulates the refrigerant.

A specific configuration of the ejector 20 will be described referring to FIGS. 2 to 5. The ejector 20 includes a nozzle 21, a body 22, and a needle valve 23, for example. The nozzle 21 is formed of metal (for example, stainless alloy) that has an approximately circular cylindrical shape gradually tapered toward a flow direction of the refrigerant, and the nozzle 21 jets the refrigerant after isentropically decompressing the refrigerant in a nozzle passage 20*a* defined in the nozzle 21.

In the nozzle 21, the needle valve 23 that has a needle shape and works as a passage forming member is provided. The refrigerant passage defined between an inner peripheral surface of the nozzle 21 and an outer peripheral surface of the needle valve 23 defines at least a part of the nozzle passage 20*a* that decompresses the refrigerant. Accordingly, in an area where the nozzle 21 and the needle valve 23 overlap when viewed in a direction perpendicular to an axial direction of the nozzle 21, a cross-sectional shape of the nozzle passage 20*a* taken along the direction perpendicular to the axial direction is an annular shape.

On an inner wall surface of the nozzle 21, a throat portion 21*b* defining a smallest passage cross-sectional area portion 20*b* in which a sectional area of the refrigerant passage decreases the most is provided. Therefore, the nozzle passage 20*a* includes a convergent portion 20*c* on a refrigerant upstream side of the smallest passage cross-sectional area portion 20*b*, and a divergent portion 20*d* on a refrigerant downstream side of the smallest passage cross-sectional area portion 20*b*. In the convergent portion 20*c*, the sectional area of the refrigerant passage is gradually decreased toward the smallest passage cross-sectional area portion 20*b*. In the divergent portion 20*d*, the sectional area of the refrigerant passage is gradually enlarged.

In other words, the sectional area of the refrigerant passage in the nozzle passage 20*a* of the present embodiment changes similarly to a laval nozzle. Moreover, in the present embodiment, the refrigerant passage cross-sectional area of the nozzle passage 20*a* is changed such that the ejection refrigerant jetted from a refrigerant ejection port 21*c* is equal to or more than the sound speed during a normal operation of the ejector-type refrigeration cycle 10.

Furthermore, a cylinder portion 21*d* extending coaxially with an axis line of the nozzle 21 is provided upstream of a part defining the nozzle passage 20*a* of the nozzle 21. A swirl space 20*e* that swirls the refrigerant flowing into the nozzle 21 is provided inside the cylinder portion 21*d*. The swirl space 20*e* has an approximately circular column shape extending coaxially with the axis line of the nozzle 21.

Moreover, a refrigerant inflow passage, through which the refrigerant flows from an outside of the ejector 20 into the swirl space 20*e*, extends in a tangential direction of an inner wall surface of the swirl space 20*e* when viewed from a direction of an center axis of the swirl space 20*e*. According to this, the subcooled liquid-phase refrigerant flowing out of the radiator 12 and into the swirl space 20*e* flows along the inner wall surface of the swirl space 20*e* and swirls about the center axis of the swirl space 20*e*.

Since a centrifugal force is exerted on the refrigerant swirling in the swirl space 20*e*, a pressure of the refrigerant on a center axis side is lower than a pressure of the refrigerant on an outer peripheral side in the swirl space 20*e*. In the present embodiment, dimensions of the swirl space 20*e*, for example, are set such that the refrigerant pressure on the center line side in the swirl space 20*e* is decreased to a pressure of a saturated liquid-phase refrigerant or a pressure at which the refrigerant is boiled due to a pressure decrease (a cavitation occurs) during a low-load operation, in which a thermal load of the ejector-type refrigeration cycle 10 is relatively low, and a middle-load operation, in which the thermal load of the ejector-type refrigeration cycle 10 is a medium value.

Such adjustment of the refrigerant pressure on the center line side in the swirl space 20*e* can be achieved by adjusting a swirling speed of the refrigerant swirling in the swirl space 20*e*. Moreover, the adjustment of the swirling speed can be achieved by, for example, adjusting a dimensional relationship such as a ratio of the passage cross-sectional area of the refrigerant inflow passage to a sectional area of the swirl space 20*e* taken along a line perpendicular to the axial direction. In the present embodiment, the swirling speed means a flow rate of the refrigerant around an outermost part of the swirl space 20*e* in the swirl direction.

Accordingly, in the present embodiment, the cylinder portion 21*d* and the swirl space 20*e* constitutes a swirl flow generating portion that swirls, around the axis of the nozzle 21, the subcooled liquid-phase refrigerant flowing into the nozzle 21. That is, in the present embodiment, the ejector 20 (specifically, nozzle 21) and the swirl flow generating portion are provided integrally with each other.

The body 22 is formed of metal (for example, aluminum) or resin shaped in an approximately circular cylinder shape, and the body 22 works as a fixation member that supports and fixes the nozzle 21 in an inside thereof and constitutes an outer body of the ejector 20. Specifically, the nozzle 21 is housed and fixed by press-fitting to one end of the body 22 in a longitudinal direction. Accordingly, the refrigerant is prevented from leaking through a fixation portion (press-fitting portion) of the nozzle 21 and the body 22.

A refrigerant suction port 22*a* extending through the body 22 is provided in a part of an outer peripheral surface of the body 22 which corresponds to an outer peripheral side of the nozzle 21. The refrigerant suction port 22*a* is communicated with the refrigerant ejection port 21*c* of the nozzle 21. The refrigerant suction port 22*a* is a through-hole through which the refrigerant flowing out of the evaporator 14 is drawn from the outside to the inside due to a drawing effect of the ejection refrigerant jetted from the nozzle 21.

A suction passage 20*f* and a diffuser portion 20*g* are provided in the body 22. The suction passage 20*f* guides the refrigerant drawn through the refrigerant suction port 22*a* to the refrigerant ejection port side of the nozzle 21. The diffuser portion 20*g* is a pressure increasing portion in which the refrigerant drawn through the refrigerant suction port 22*a* into the inside of the ejector 20 is mixed with the ejected refrigerant, a pressure of the mixed refrigerant being increased in the diffuser portion 20*g*.

The diffuser portion 20*g* is defined as a space that is positioned so as to continue to an outlet of the suction passage 20*f*. The refrigerant passage area is gradually enlarged in the space. According to this, the diffuser portion 20*g* performs a function for mixing the ejected refrigerant and the drawn refrigerant, decreasing the flow rate of the mixed refrigerant, and increasing the pressure of the mixed refrigerant of the ejected refrigerant and the drawn refrigerant. In other words, the diffuser portion 20*g* performs a function for converting a velocity energy of the mixed refrigerant to a pressure energy.

The needle valve 23 works as a passage forming member and changes the passage cross-sectional area of the nozzle passage 20*a*. Specifically, the needle valve 23 is made of resin and has a needle shape tapered from the diffuser portion 20*g* side toward the refrigerant upstream side (nozzle passage 20*a* side). The needle valve 23 may be made of metal.

Moreover, the needle valve 23 is located coaxially with the nozzle 21. An electric actuator 23*a* including a stepper motor as a driving device that moves the needle valve 23 in the axial direction of the nozzle 21 is connected to an end portion of the needle valve 23 on the diffuser portion 20*g* side. The actuation of the electric actuator 23*a* is controlled by a control pulse outputted from the air conditioning control unit 50.

In contrast, a tip portion 23*b* of the needle valve 23 that defines the smallest passage cross-sectional area portion 20*b* on the inner peripheral side of the throat portion 21*b* of the nozzle 21 is provided in an end portion of the needle valve 23 on the nozzle passage 20*a* side. That is, the tip portion 23*b* changes the passage cross-sectional area (smallest passage cross-sectional area) at the smallest passage cross-sectional area portion 20*b* when the needle valve 23 is moved in the axial direction.

The tip portion 23*b* has a shape of a solid of revolution in which the sectional area taken in the direction perpendicular to the axial direction gradually increases toward the downstream side of the refrigerant flow. The shape of the solid of revolution is a 3D shape that is formed when a 2D shape is rotated about a line (center line) that lies on the same plane as the 2D shape. A tip of the tip portion 23*b* has a hemisphere shape. Accordingly, in a sectional surface including the center line of the tip portion 23*b*, an outline of the tip of the tip portion 23*b* is a parabola.

Figure 3:
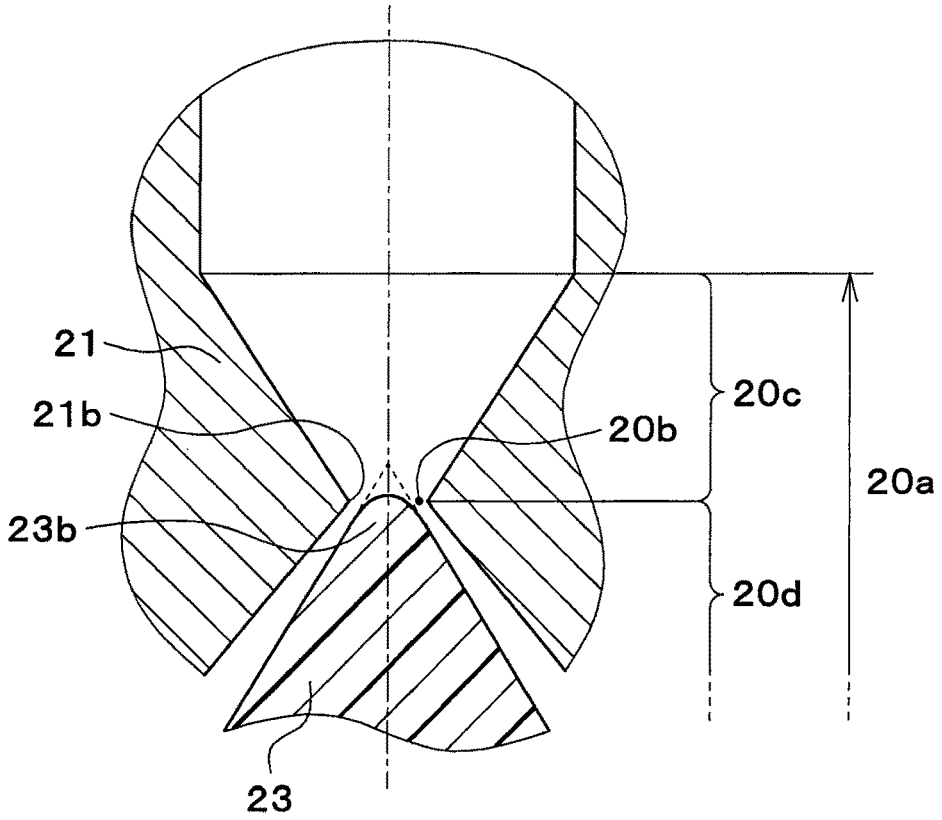
FIG. 3 is an enlarged sectional diagram illustrating a III part of FIG. 2 that is enlarged in a schematic way.

Therefore, a tip of the sectional shape of the tip portion 23*b* indicated by a solid line in FIG. 3 is shorter than a tip having a circular cone shape indicated by a thin and dashed line in FIG. 3. Moreover, the sectional shape of the tip portion 23*b* has a shape in which an increase rate of a distance from the center line is decreased from the tip. FIG. 3 is a schematic sectional diagram in which a dimension in the direction perpendicular to the center line of the nozzle 21 is enlarged more than a dimension in the direction of the center line for clear description. The tip portion 23*b* may be chamfered.

Figure 4:
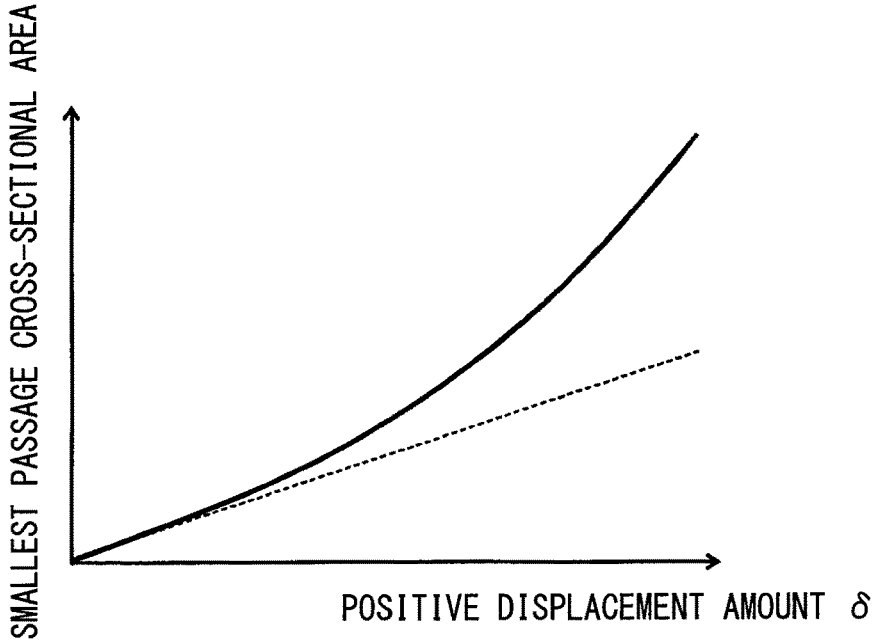
FIG. 4 is a graph illustrating a change of a passage cross-sectional area of a smallest passage cross-sectional area portion when a positive displacement amount is changed, in the ejector of the first embodiment.

According to this, the tip portion 23*b* of the ejector 20 of the present embodiment has a shape in which an increase rate (a gradient of a thick and solid line of FIG. 4) of the passage cross-sectional area of the smallest passage cross-sectional area portion 20*b* continuously increases according to an increase of a positive displacement amount δ, as shown in FIG. 4.

The positive displacement amount δ is a displace amount of the needle valve 23 when the needle valve 23 is moved toward a direction in which the passage cross-sectional area of the smallest passage cross-sectional area portion 20*b* is increased. Accordingly, when the needle valve 23 is in contact with the nozzle 21 to close the nozzle passage 20*a*, the positive displacement amount δ is zero.

According to the ejector 20 of the present embodiment, when the positive displacement amount δ is increased, the passage cross-sectional area of the smallest passage cross-sectional area portion 20*b* can be enlarged more compared to a case where the passage cross-sectional area of the smallest passage cross-sectional area portion 20*b* is increased in proportion to the increase of the positive displacement amount δ indicated by a dashed line of FIG. 4.

Figure 5:
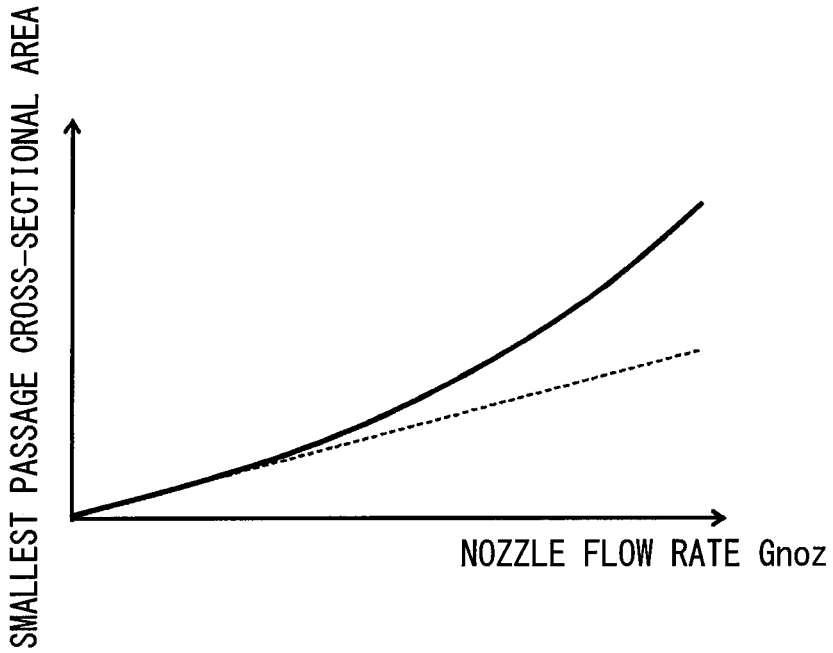
FIG. 5 is a graph illustrating a change of the passage cross-sectional area of the smallest passage cross-sectional area portion when a nozzle flow rate is changed, in the ejector of the first embodiment.

In the ejector 20 of the present embodiment, since the tip portion 23*b* is employed, the increase rate (a gradient of thick and solid line of FIG. 5) of the passage cross-sectional area of the smallest passage cross-sectional area portion 20*b* increases according to an increase of the flow rate (nozzle flow rate Gnoz) of the refrigerant flowing through the nozzle passage 20*a*, as shown in FIG. 5.

In the ejector 20 of the present embodiment, the passage cross-sectional area of the smallest passage cross-sectional area portion 20*b* is enlarged more compared to a case where the passage cross-sectional area of the smallest passage cross-sectional area portion 20*b* is increased in proportion to the increase of the nozzle flow rate Gnoz as indicated by a dashed line of FIG. 5.

An inlet side of a gas-liquid separator 13 is connected to a refrigerant outlet of the diffuser portion 20*g* of the ejector 20 as shown in FIG. 1. The gas-liquid separator 13 is a gas-liquid separation device that separates the refrigerant flowing out of the diffuser portion 20*g* of the ejector 20 into the gas-phase refrigerant and the liquid-phase refrigerant. In the present embodiment, a device having a relatively small capacity which causes the liquid-phase refrigerant to flow out from a liquid-phase refrigerant outlet without accumulating much liquid-phase refrigerant is used as the gas-liquid separator 13. However, a device that can function as an accumulator storing a surplus liquid-phase refrigerant in the cycle may be used as the gas-liquid separator 13.

A gas-phase refrigerant outlet of the gas-liquid separator 13 is connected to an inlet side of the compressor 11. In contrast, the liquid-phase refrigerant outlet of the gas-liquid separator 13 is connected to a refrigerant inlet side of the evaporator 14 through a fixed throttle 13*a* that is a decompression device. As the fixed throttle 13*a*, an orifice or a capillary tube can be employed, for example.

The evaporator 14 is a heat absorbing heat exchanger that causes the low-pressure refrigerant to evaporate and to perform heat absorbing effect by performing a heat exchange between the low-pressure refrigerant flowing therein and the blown air that is blown from the a blowing fan 14*a* toward the vehicle compartment. The blowing fan 14*a* is an electric blower whose rotation speed (an amount of the blown air) is controlled by a control voltage outputted from the air conditioning control unit 50. A refrigerant outlet of the evaporator 14 is connected to a refrigerant suction port 22*a* side of the ejector 20.

Next, a general configuration of an electric controller of the present embodiment will be described. The air conditioning control unit 50 is constituted by a microcomputer including CPU, ROM and RAM, for example, and its peripheral circuit. The air conditioning control unit 50 performs calculations and processing based on control programs stored in the ROM to control actuations of the above-described electric actuators 11, 12*d*, 14*a*, 23*a*, for example.

The air conditioning control unit 50 is connected to sensors for air conditioning control such as an inside air temperature sensor for detecting a vehicle interior temperature (interior temperature) Tr, an outside air temperature sensor for detecting the temperature of an outside air Tam, an insolation sensor for detecting the amount of insolation As in the vehicle compartment, an evaporator outlet side temperature sensor (evaporator outlet side temperature detection device) 51 for detecting the temperature Te of the refrigerant on the outlet side of the evaporator 14 (evaporator outlet side temperature), an evaporator outlet side pressure sensor (evaporator outlet side pressure detection device) 52 for detecting the pressure Pe of the refrigerant on the outlet side of the evaporator 14, a radiator outlet side temperature sensor for detecting the temperature Td of the refrigerant on the outlet side of the radiator 12, and an outlet side pressure sensor for detecting a pressure Pd on the outlet side of the radiator 12, and detection values of the sensors are inputted to the air conditioning control unit 50.

Moreover, an input side of the air conditioning control unit 50 is connected to an operation panel, which is not shown, located close to an instrument panel in a front part of the vehicle compartment, and an operation signal of an operation switch provided in the operation panel is inputted to the air conditioning control unit 50. The operation switch provided in the operation panel includes an air conditioning actuation switch for requiring the air conditioning of the vehicle compartment, and a vehicle compartment temperature setting switch for setting a vehicle inside temperature Tset.

In the air conditioning control unit 50, control units that control actuations of various control target devices connected to the output side of the control unit are integrated with each other, and a part of the air conditioning control unit 50 (hardware and software) controlling respective control target device constitutes a control unit for respective control target device.

For example, in the present embodiment, a part controlling the actuation of the compressor 11 constitutes a discharge capacity control portion 50*a*, and a part controlling the actuation of electric actuator 23*a* constitutes a valve opening degree control portion 50*b*. It is needless to say that the discharge capacity control portion 50*a* and the valve opening degree control portion 50*b* may be provided as separate control units from the air conditioning control unit 50.

Next, actuations of the above-described configurations of the present embodiment will be described. In the vehicular air conditioning device of the present embodiment, when the air conditioning actuation switch of the operation panel is turned on (ON), the air conditioning control unit 50 executes an air conditioning control program that is preliminary stored.

In the air conditioning control program, the detection signals of the above-described sensors for air conditioning control and operation signals of the operation panel are read. A target blown air temperature TAO that is a target temperature of the air blown into the vehicle compartment is calculated based on the detection signals and the operation signals.

The target blown air temperature TAO is calculated based on an expression F1 below.

$$TAO = Kset \times Tset - Kr \times Tr - Kam \times Tam - Ks \times As + C \quad (F1)$$

Tset is the vehicle inside temperature that is set by the temperature setting switch, Tr is the inside temperature detected by the inside temperature sensor, Tam is the outside temperature detected by the outside temperature sensor, and As is the amount of the insolation detected by the insolation sensor. Kset, Kr, Kam, and Ks are control gains, and C is a constant for correction.

Moreover, in the air conditioning control program, operation states of the control target devices connected to the output side of the air conditioning control unit 50 are decided based on the calculated target blown air temperature TAO and the detection signals of the sensors.

For example, the refrigerant discharge capacity of the compressor 11, i.e. the control signal outputted to the electric motor of the compressor 11, is decided as described below. First, a control map that is preliminary stored in a memory circuit is referred based on the target blown air temperature TAO, and then a target evaporator air temperature TEO of the blown air blown from the evaporator 14 is decided.

The control signal outputted to the electric motor of the compressor 11 is decided based on a deviation (TEO−Te) between the evaporator outlet side temperature Te detected by the evaporator outlet side temperature sensor 51 and the target evaporator air temperature TEO such that the evaporator outlet side temperature Te becomes close to the target evaporator air temperature TEO by using a feedback control method.

Specifically, the discharge capacity control portion 50*a* of the present embodiment controls the refrigerant discharge capacity (rotation speed) of the compressor 11 such that the amount of the refrigerant circulating in the cycle increases according to increase of the deviation (TEO−Te), i.e. increase of the thermal load of the ejector-type refrigeration cycle 10.

The control pulse outputted to the electric actuator 23*a* that moves the needle valve 23 is decided such that the degree of superheat SH of the refrigerant on the outlet side of the evaporator 14, which is calculated based on the evaporator outlet side temperature Te and the evaporator outlet side pressure Pe detected by the evaporator outlet side pressure sensor 52, comes closer to a predetermined reference superheat degree KSH.

Specifically, the valve opening degree control portion 50*b* of the present embodiment controls the actuation of the electric actuator 23*a* such that the passage cross-sectional area of the smallest passage cross-sectional area portion 20*b* is increased according to the increase of the degree of superheat SH of the refrigerant on the outlet side of the evaporator 14. Therefore, in the ejector 20 of the present embodiment, thermal load of the ejector-type refrigeration cycle 10 becomes higher, and the passage cross-sectional area of the smallest passage cross-sectional area portion 20*b* is increased according to the increase of the nozzle flow rate Gnoz.

The air conditioning control unit 50 outputs the decided control signals to corresponding control target devices. Subsequently, a control routine is repeated until a stop of the actuation of the vehicular air conditioning device is required, in which the above-described detection signals and operation signals are read, the target blown air temperature TAO is calculated, the actuation states of the control target devices are decided, and the control signals are outputted.

Therefore, in the ejector-type refrigeration cycle 10, the refrigerant flows as indicated by the thick and solid arrow of FIG. 1. The state of the refrigerant changes as shown in the Mollier diagram of FIG. 6.

In more detail, the high-temperature and high-pressure refrigerant (point a of FIG. 6) discharged from the compressor 11 flows into the condensing portion 12*a* of the radiator 12 and exchanges heat with the outside air blown by the cooling fan 12*d*, and the refrigerant dissipates heat to be condensed. The refrigerant condensed in the condensing portion 12*a* is separated into the gas-phase refrigerant and the liquid-phase refrigerant in the receiver portion 12*b*. The liquid-phase refrigerant separated in the receiver portion 12*b* exchanges heat, in the subcooling portion 12*c*, with the outside air blown by the cooling fan 12*d*, and the refrigerant further dissipates heat to become a subcooled liquid-phase refrigerant (from the point a to a point b of FIG. 6).

Figure 6:
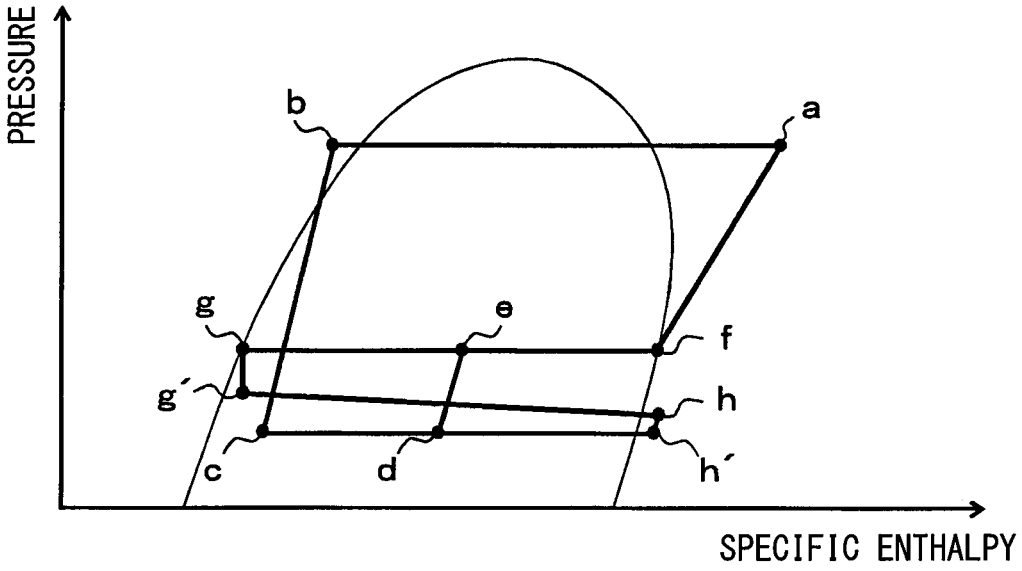
FIG. 6 is a Mollier diagram illustrating a change in a state of a refrigerant in the ejector-type refrigeration cycle according to the first embodiment.

A pressure of the subcooled liquid-phase refrigerant flowing out of the subcooling portion 12*c* of the radiator 12 is isentropically reduced in the nozzle passage 20*a* of the ejector 20 and ejected (from the point b to a point c of FIG. 6). At this time, the valve opening degree control portion 50*b* controls the actuation of the electric actuator 23*a* such that the degree of superheat SH of the refrigerant on the outlet side of the evaporator 14 (point h of FIG. 6) comes close to the predetermined reference degree of superheat KSH.

The refrigerant flowing out of the evaporator 14 (point h of FIG. 6) is drawn through the refrigerant suction port 22*a* by the suction effect of the ejected refrigerant jetted from the nozzle passage 20*a*. The ejected refrigerant jetted from the nozzle passage 20*a* and the drawn refrigerant drawn through the refrigerant suction port 22*a* flow into the diffuser portion 20*g* and join together (from the point c to a point d, and from a point h' to the point d of FIG. 6).

The suction passage 20*f* of the present embodiment is formed such that the passage cross-sectional area is gradually decreased in the refrigerant flow direction. Therefore, the pressure of the drawn refrigerant that passes the suction passage 20*f* decreases (from the point h to the point h' of FIG. 6), and the flow rate of the drawn refrigerant that passes the suction passage 20*f* increases. Accordingly, a difference in velocity between the drawn refrigerant and the ejected refrigerant, and an energy loss (mixing loss) when the drawn refrigerant and the ejected refrigerant are mixed in the diffuser portion 20*g* is decreased.

In the diffuser portion 20*g*, a kinetic energy of the refrigerant is converted into a pressure energy by an increase of the refrigerant passage cross-sectional area. Accordingly, a pressure of the mixed refrigerant is increased while the ejected refrigerant and the drawn refrigerant are mixed (from a point e to the point d of FIG. 6). The refrigerant flowing out of the diffuser portion 20*g* is separated in the gas-liquid separator 13 into the gas-phase refrigerant and the liquid-phase refrigerant (from the point e to a point f, and from the point e to a point g of FIG. 6).

The liquid-phase refrigerant separated in the gas-liquid separator 13 is decompressed by the fixed throttle 13*a* (from a point g' to the point g of FIG. 6) and flows into the evaporator 14. The refrigerant flowing into the evaporator 14 absorbs heat from the blown air blown by the blowing fan 14*a* and is evaporated (from the point h to the point g' of FIG. 6). According to this, the blown air is cooled. In contrast, the gas-phase refrigerant separated in the gas-liquid separator 13 is drawn into the compressor 11 and compressed again (from the point f to the point a of FIG. 6).

The ejector-type refrigeration cycle 10 of the present embodiment is actuated as described above and is capable of cooling the blown air blown to the vehicle compartment.

In the ejector-type refrigeration cycle 10 of the present embodiment, the refrigerant whose pressure is increased in the diffuser portion 20*g* of the ejector 20 is drawn into the compressor 11. Accordingly, the ejector-type refrigeration cycle 10 is capable of reducing power consumption of the compressor 11 to improve the coefficient of performance (COP) of the cycle compared to a conventional refrigeration cycle device in which a refrigerant evaporation pressure in an evaporator and a pressure of the refrigerant drawn to a compressor are almost the same.

Since the ejector 20 of the present embodiment includes the needle valve 23 that is the passage forming member and the electric actuator 23*a* that is a driving device, the passage cross-sectional area of the smallest passage cross-sectional area portion 20*b* can be adjusted according to a change of the load of the ejector-type refrigeration cycle 10. Accordingly, the ejector 20 can be properly actuated according to the change of the load of the ejector-type refrigeration cycle 10.

Moreover, according to the ejector 20 of the present embodiment, since the refrigerant is swirled in the swirl space 20*e* during the low-load operation and the middle-load operation of the ejector-type refrigeration cycle 10, the pressure of the refrigerant on a center side of the swirl in the swirl space 20*e* can be reduced such that the refrigerant becomes to be the saturated liquid-phase refrigerant or is to be boiled due to the pressure decrease (a cavitation occurs).

Figure 7:
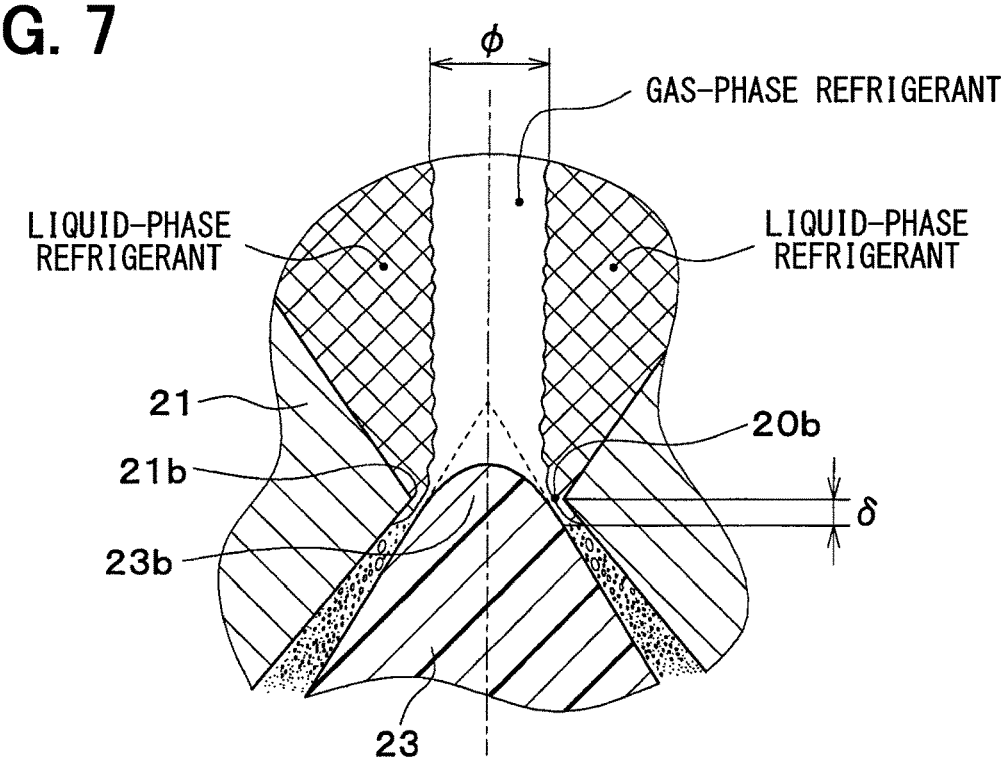
FIG. 7 is an explanatory diagram for explaining a state of boil of the refrigerant during a low-load operation and a middle-load operation of the ejector according to the first embodiment.
Figure 8:
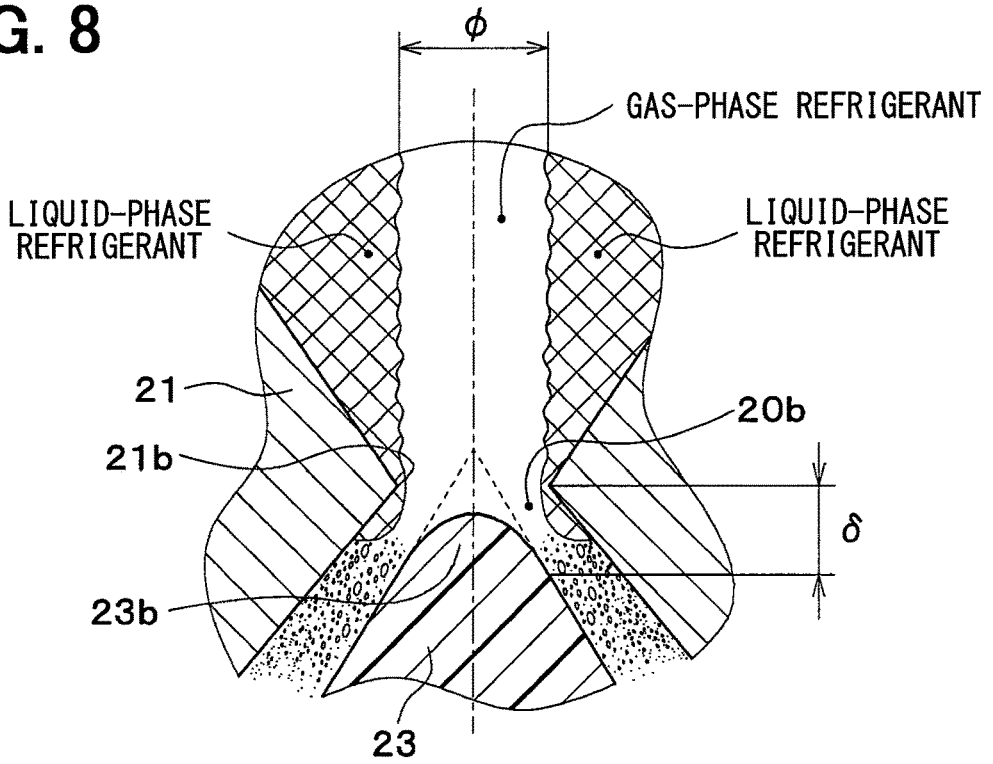
FIG. 8 is an explanatory diagram for explaining a state of boil of the refrigerant during a high-load operation of the ejector according to the first embodiment.

According to this, since the gas-phase refrigerant having a column shape (air column) is provided on an inner side of a center axis of the swirl as shown in FIG. 7, the refrigerant becomes two-phase-separated state, in which the refrigerant around the center axis of the swirl in the swirl space 20*e* is a gas-single-phase refrigerant and the refrigerant around the gas-single-phase refrigerant is a liquid-single-phase refrigerant. FIGS. 7 and 8 is an explanatory diagram in which the cross-section similar to FIG. 3 is enlarged and a situation of the boiling refrigerant is described schematically. In FIGS. 7 and 8, the liquid-phase refrigerant is indicated by a shading hatching for clear description.

Since the refrigerant in the two-phase-separated state in the swirl space 20*e* flows into the nozzle passage 20*a*, boiling of the refrigerant is enhanced by a wall surface boiling, which occurs when the refrigerant is separated from the outer peripheral wall surface of the refrigerant passage having a circular annular shape, and an interface boiling, which is caused by a boiling core generated by the cavitation of the refrigerant on the center axis side of the refrigerant passage having a circular annular shape.

According to this, the refrigerant flowing into the smallest passage cross-sectional area portion 20*b* of the nozzle passage 20*a* becomes a gas-liquid mixed state in which the gas-phase refrigerant and the liquid-phase refrigerant are uniformly mixed. The flow of the refrigerant in the gas-liquid mixed state is throttled (choking) around the smallest passage cross-sectional area portion 20*b*, and the refrigerant in the gas-liquid mixed state achieving sound speed due to the choking is accelerated in and jetted from the divergent portion 20*d*.

In the low-load operation and the middle-load operation of the cycle, since the refrigerant in the gas-liquid mixed state is efficiently accelerated up to sound speed by boiling enhancement due to both the wall surface boiling and the interface boiling, the efficiency of the energy conversion in the nozzle passage 20*a* can be improved.

In the ejector 20 of the present embodiment, shapes of the swirl space 20*e* and a flow-in refrigerant passage through which the refrigerant flowing into the swirl space 20*e* may have the same shapes. Accordingly, when the amount of the circulating refrigerant flow is changed due to the change of the load of the cycle, the shape of the air column formed in the swirl space 20*e* is also changed.

In more detail, since the velocity of the swirling flow of the refrigerant swirling in the swirl space 20*e* increases during a high-load operation of the cycle, a diameter ø of the air column formed in the swirl space 20*e* is larger than that during a the low-load operation and the middle-load operation. Therefore, during the high-load operation, the inner side area in the smallest passage cross-sectional area into which a low density gas-phase refrigerant flows is likely to be large, and the outer side area into which a high density liquid-phase refrigerant flows is likely to be small.

Accordingly, during the high-load operation, the pressure loss occurring when the refrigerant flows through the smallest passage cross-sectional area portion 20*b* is likely to increase even when the electric actuator 23*a* moves the needle valve 23 such that the passage cross-sectional area of the smallest passage cross-sectional area portion 20*b* increases, and accordingly coefficient of discharge of the nozzle passage 20*a* may decrease.

In contrast, in the ejector 20 of the present embodiment, the increase rate of the passage cross-sectional area of the smallest passage cross-sectional area portion 20*b* is increased according to the increase of the positive displacement amount δ of the needle valve 23. Accordingly, the passage cross-sectional area of the smallest passage cross-sectional area portion 20*b* can be sufficiently increased such that the coefficient of discharge does not decrease by increasing the positive displacement amount δ during the high-load operation of the ejector-type refrigeration cycle 10.

Specifically, the passage cross-sectional area of the smallest passage cross-sectional area portion 20*b* can be increased compared to a case where a needle valve whose tip portion is circular cone shape as indicated by thin and dashed line of FIG. 8 is employed. Accordingly, even when the diameter of the air column is increased during the high-load operation, the gas-phase refrigerant flowing into the smallest passage cross-sectional area portion 20*b* is likely to escape toward the swirl center side, and the liquid-phase refrigerant on the outer side easily flows into the smallest passage cross-sectional area portion 20*b*.

Consequently, according to ejector 20 of the present embodiment, increase of the pressure loss occurring when the refrigerant flowing through the nozzle passage 20*a* during the high-load operation can be limited, and a large decrease of coefficient of discharge during the high-load operation can be limited.

Moreover, in the ejector 20 of the present embodiment, the increase rate of the passage cross-sectional area of the smallest passage cross-sectional area portion 20*b* becomes large according to increase of the nozzle flow rate Gnoz as described with reference to FIG. 5. Accordingly, the passage cross-sectional area of the smallest passage cross-sectional area portion 20*b* during the high-load operation is easily increased above a passage cross-sectional area required for limiting the decrease of the efficient of discharge.

In a common nozzle through which the refrigerant that does not swirl about an axis, when a pressure difference between an inlet side fluid pressure and an outlet side fluid pressure of the nozzle is constant, the nozzle flow rate Gnoz can be increased in proportion to an increase of the passage cross-sectional area of the smallest passage cross-sectional area portion.

Therefore, when the increase rate of the passage cross-sectional area of the smallest passage cross-sectional area portion 20*b* becomes large according to increase of the nozzle flow rate Gnoz, the passage cross-sectional area of the smallest passage cross-sectional area portion 20*b* during the high-load operation can be surely over the passage cross-sectional area required for flowing the nozzle flow rate Gnoz. Accordingly, the passage cross-sectional area of the smallest passage cross-sectional area portion 20*b* during the high-load operation is easily increased over the passage cross-sectional area required for limiting the decrease of efficient of discharge.

Moreover, in the ejector 20 of the present embodiment, the tip portion 23*b* has the shape of a solid of revolution in which the sectional area taken in the direction perpendicular to the axial direction gradually increases, and the tip portion 23*b* has a shape in which an increase rate of a distance from the center line to the tip portion 23*b* is decreased from the tip. Accordingly, the tip portion 23*b* of the needle valve 23, by which the increase rate of the passage cross-sectional area of the smallest passage cross-sectional area portion 20*b* is increased according to increase of the positive displacement amount δ, can be easily obtained.

Second Embodiment

Figure 9:
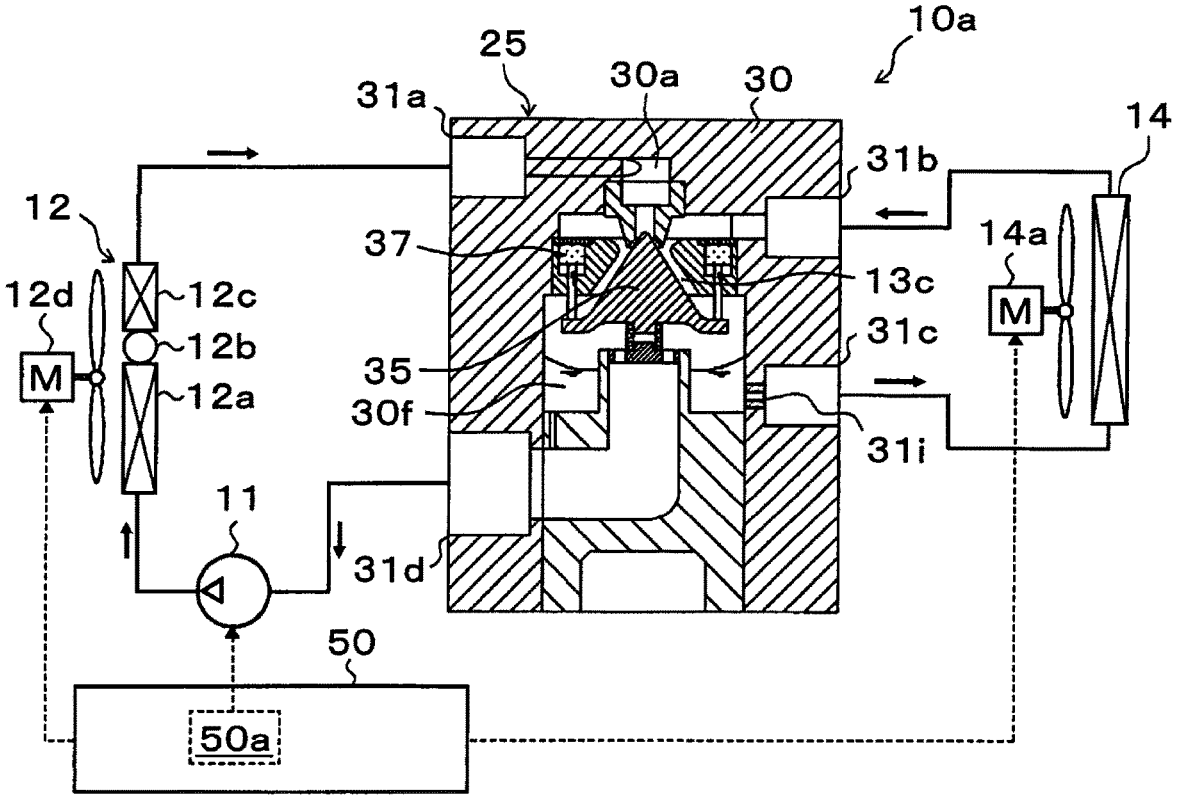
FIG. 9 is a diagram illustrating an entire structure of an ejector-type refrigeration cycle according to a second embodiment.

In the present embodiment, as compared with the first embodiment, an example of an ejector-type refrigeration cycle 10*a* will be described below, in which an ejector 25 is employed as shown in the overall configuration diagram of FIG. 9. In FIG. 9, a part that is the same as or equivalent to a matter described in the first embodiment may be assigned the same reference numeral. The same is applied to the following diagrams. In FIG. 9, sensors for air conditioning such as an evaporator outlet side temperature sensor 51 or an evaporator outlet side pressure sensor 52 are omitted for the sake of clarifying the drawing.

The ejector 25 of the present embodiment is a device in which configurations corresponding to the ejector 20, the gas-liquid separator 13, and the fixed throttle 13*a* described in the first embodiment are integrated (modularized) with each other. Accordingly, the ejector 25 may be referred to as "an ejector with gas-liquid separation function" or "an ejector module".

Specific configuration of the ejector 25 will be described below referring to FIGS. 10, 11. An up-down arrow of FIG. 10 indicates an upward direction and a downward direction in a situation where the ejector 25 is installed in the ejector-type refrigeration cycle 10*a*, respectively. FIG. 11 is a sectional diagram schematically illustrating XI part of FIG. 10 and corresponds to FIG. 3 of the first embodiment.

Figure 10:
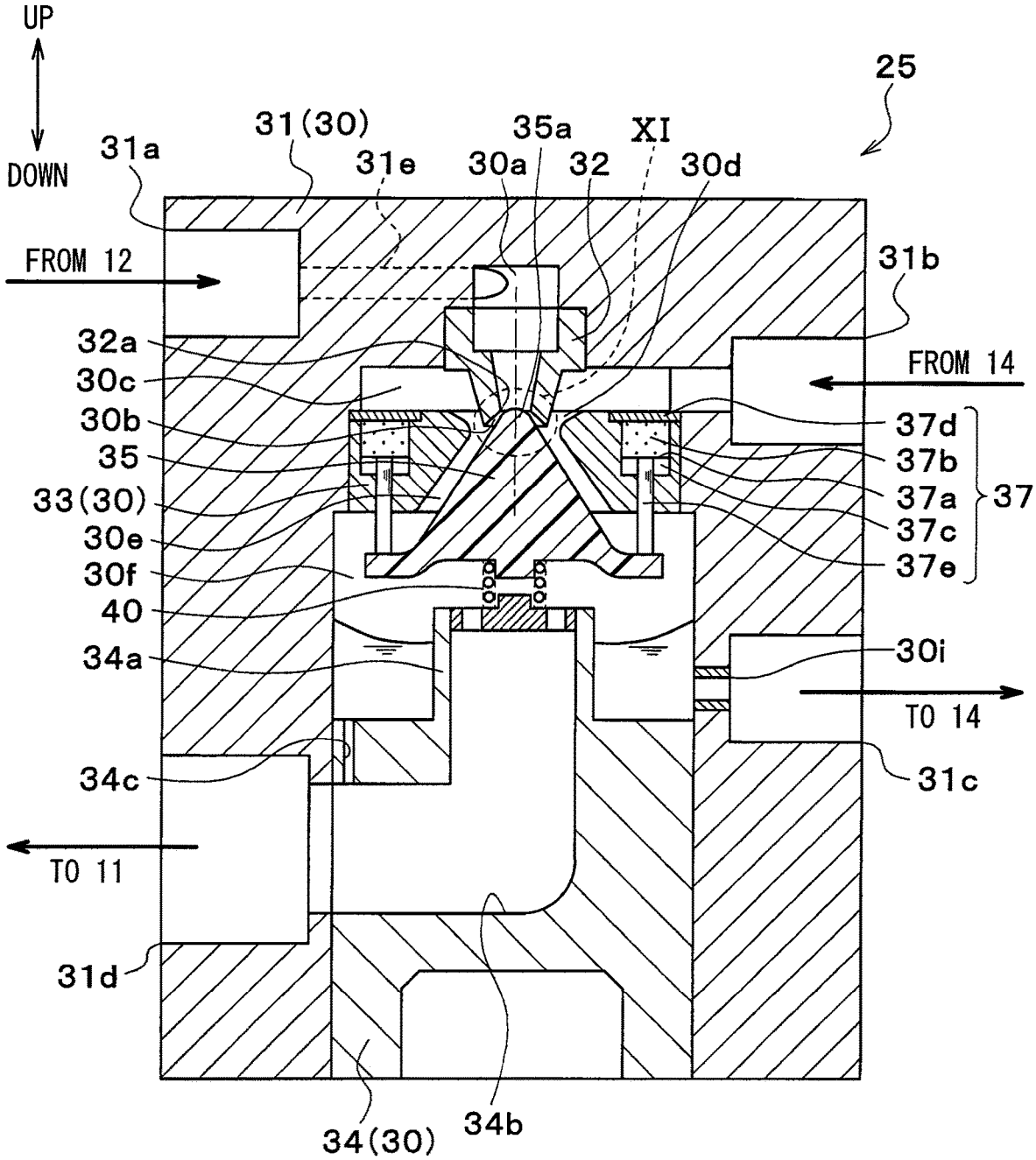
FIG. 10 is a sectional diagram illustrating an ejector taken along an axial direction, according to the second embodiment.
Figure 11:
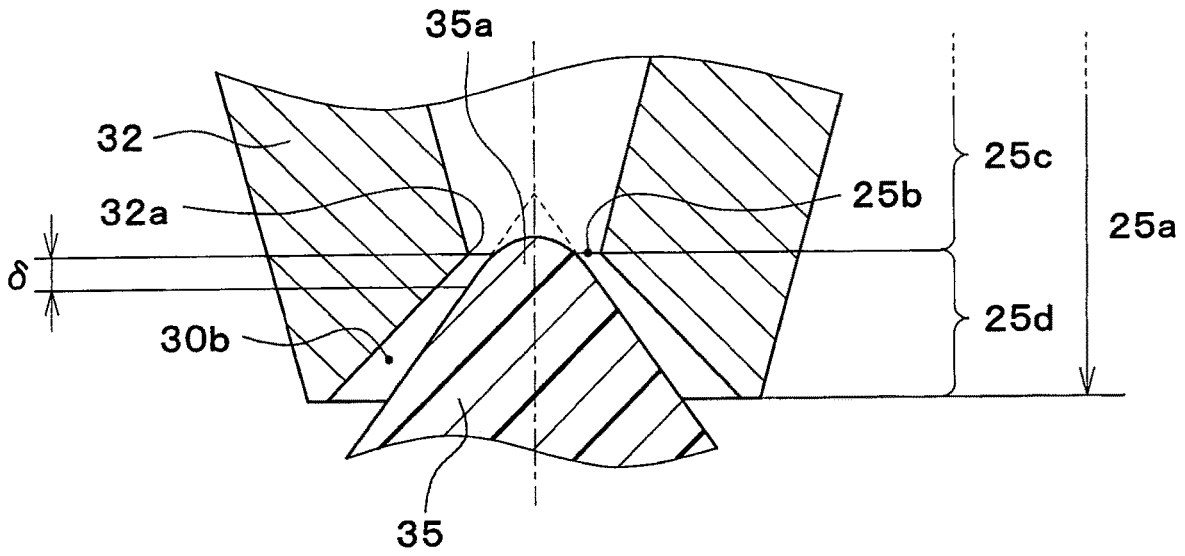
FIG. 11 is an enlarged sectional diagram illustrating a XI part of FIG. 10 that is enlarged in a schematic way.

The ejector 25 includes a body 30 that is formed by combining multiple components as shown in FIG. 10. Specifically, the body 30 includes a housing body 31 made of metal or resin having a prism or circular column shape, the housing body 31 forming an outer casing of the ejector 25. Moreover, a nozzle 32, a middle body 33, and a lower body 34 are fixed to an inside of the housing body 31, for example.

The housing body 31 includes: a refrigerant inlet 31*a* into which the refrigerant flowing out of a radiator 12 flows; a refrigerant suction port 31*b* through which the refrigerant flowing out of an evaporator 14 is drawn; a liquid-phase refrigerant outlet 31*c* through which the liquid-phase refrigerant separated in a gas-liquid separation space 30*f* defined in the body 30 flows out toward a refrigerant inlet side of the evaporator 14; and a gas-phase refrigerant outlet 31*d* through which the gas-phase refrigerant separated in the gas-liquid separation space 30*f* flows out toward an inlet side of a compressor 11, for example.

Moreover, in the present embodiment, an orifice 31*i* that is a decompression device decompressing the refrigerant flowing into the evaporator 14 is provided in a liquid-phase refrigerant passage through which the gas-liquid separation space 30*f* is communicated with the liquid-phase refrigerant outlet 31*c*. The gas-liquid separation space 30*f* of the present embodiment corresponds to the gas-liquid separator 13 described in the first embodiment, and the orifice 31*i* of the present embodiment corresponds to the fixed throttle 13*a* described in the first embodiment.

The nozzle 32 of the present embodiment is formed of a metal material (e.g. stainless alloy) having an approximately circular cone shape tapered in the refrigerant flow direction. The nozzle 32 is fixed to the inside of the housing body 31 by press-fitting, for example, such that an axial direction is a vertical direction (up-down direction of FIG. 10). A swirl space 30*a* having an approximately circular column shape and causing the refrigerant flowing through the refrigerant inlet 31*a* to swirl is defined between an upper side of the nozzle 32 and the housing body 31.

A refrigerant inlet passage 31*e* that provides a connection between the refrigerant inlet 31*a* and the swirl space 30*a* extends in a tangential direction of an inner wall surface of the swirl space 30*a* when viewed from a direction of an center axis of the swirl space 30*a*. According to this, the refrigerant flowing into the swirl space 30*a* through the refrigerant inlet passage 31*e* flows along the inner wall surface of the swirl space 30*a* and swirls about the center axis of the swirl space 30*a*. Accordingly, in the present embodiment, a part of the body defining the swirl space 30*a* and the swirl space 30*a* constitute a swirl flow generation portion.

Moreover, in the present embodiment, dimensions of the swirl space 30*a* are set such that a refrigerant pressure on the center line side in the swirl space 30*a* is decreased to a pressure of a saturated liquid-phase refrigerant or a pressure at which the refrigerant is boiled due to a pressure decrease (a cavitation occurs) during a low-load operation, in which a thermal load of the ejector-type refrigeration cycle 10*a* is relatively low, and a middle-load operation, in which the thermal load of the ejector-type refrigeration cycle 10*a* is a medium value.

A decompression space 30*b*, which decompresses the refrigerant flowing out of the swirl space 30*a* and flows the refrigerant to a downstream side, is defined in the nozzle 32. The decompression space 30*b* has a shape of a solid of revolution in which a circular column space and a conical frustum space continuing from a lower side of the circular column space and gradually diverging in the refrigerant flow direction are joined with each other. A center axis of the decompression space 30*b* is coaxial with the center axis of the swirl space 30*a*.

A passage forming member 35 is provided in the decompression space 30*b*. The passage forming member 35 performs the same function of the needle valve 23 described in the first embodiment. Specifically, the passage forming member 35 is made of resin and has a circular cone shape whose sectional area is increased according to a distance from the decompression space 30*b*. A center axis of the passage forming member 35 is coaxial with the center axis of the decompression space 30*b*.

According to this, at least a part of a nozzle passage 25*a*, whose cross-section is a circular annular shape, for decompressing the refrigerant is defined between an inner peripheral surface of a part of the nozzle 32 defining the decompression space 30*b* and an outer peripheral surface of the passage forming member 35, as shown in FIG. 11.

Moreover, a throat portion 32*a* defining a smallest passage cross-sectional area portion 25*b*, in which the refrigerant passage cross-sectional area is decreased the most, is provided on an inner wall surface of the nozzle 32. Therefore, the nozzle passage 25*a* includes a convergent portion 25*c* on a refrigerant upstream side of the smallest passage cross-sectional area portion 25*b*, and a divergent portion 25*d* on a refrigerant downstream side of the smallest passage cross-sectional area portion 25*b*. In the convergent portion 25*c*, the sectional area of the refrigerant passage is gradually decreased toward the smallest passage cross-sectional area portion 25*b*. In the divergent portion 25*d*, the sectional area of the refrigerant passage is gradually enlarged.

Accordingly, the refrigerant passage cross-sectional area of the nozzle passage 25*a* of the present embodiment also changes similarly to a laval nozzle. Moreover, in the present embodiment, the refrigerant passage cross-sectional area of the nozzle passage 25*a* is changed such that an ejected refrigerant jetted from the nozzle passage 25*a* is equal to or more than the sound speed during a normal operation of the ejector-type refrigeration cycle 10*a*.

Moreover, a tip portion 35*a* that defines the smallest passage cross-sectional area portion 25*b* on an inner side of the throat portion 32*a* of the nozzle 32 is provided on a tip side of the passage forming member 35 of the present embodiment, as shown in FIG. 11. The tip portion 35*a* changes the passage cross-sectional area of the smallest passage cross-sectional area portion 25*b* when the passage forming member 35 moves in the axial direction.

The tip portion 35*a* has a shape in which an increase rate of the passage cross-sectional area of the smallest passage cross-sectional area portion 20*b* increases according to an increase of a positive displacement amount δ, similarly to the tip portion 23*b* of the needle valve 23 of the first embodiment. Accordingly, in the ejector 25 of the present embodiment, the passage cross-sectional area of the smallest passage cross-sectional area portion 25*b* can be increased more than a case where the passage cross-sectional area of the smallest passage cross-sectional area portion 20*b* is increased in proportion to the increase of the positive displacement amount δ, similarly to the first embodiment.

Dashed lines of FIG. 11 indicate a sectional shape of a tip portion having a circular cone shape. This is the same in the following FIG. 12.

Next, the middle body 33 shown in FIG. 10 is a circular metal board member that includes a through-hole extending through the two sides (from an upper side to a lower side) of the middle body 33 at a center portion. Moreover, an actuation mechanism 37 moving the passage forming member 35 is provided on an outer peripheral side of the through-hole of the middle body 33. The middle body 33 is fixed to a part of the inside of the housing body 31 positioned below the nozzle 32 by press-fitting, for example.

A flow-in space 30*c* in which the refrigerant flowing through the refrigerant suction port 31*b* is accumulated is defined between an upper surface of the middle body 33 and an inner wall surface of the housing body 31. Moreover, an suction passage 30*d* through which the flow-in space 30*c* and a refrigerant downstream side of the decompression space 30*b* are communicated with each other is defined between an inner peripheral surface of the through-hole of the middle body 33 and an outer peripheral surface of a lower part of the nozzle 32.

A pressure increasing space 30*e* that has an approximately conical frustum shape gradually enlarged in the refrigerant flow direction is provided on a refrigerant downstream side of the through-hole of the suction passage 30*d* of the middle body 33. The pressure increasing space 30*e* is a space in which the ejected refrigerant jetted from the above-described nozzle passage 25*a* and the drawn refrigerant drawn through the suction passage 30*d* are mixed. A center axis of the pressure increasing space 30*e* is coaxial with the center axes of the swirl space 30*a* and the decompression space 30*b*.

A lower part of the passage forming member 35 is positioned in the pressure increasing space 30*e*. A refrigerant passage defined between an inner peripheral surface of a part of the middle body 33 defining the pressure increasing space 30*e* and a lower part of an outer peripheral surface of the passage forming member 35 has a shape whose sectional area is gradually increased toward the refrigerant downstream side. According to this, the refrigerant passage is capable of converting the velocity energy of the mixed refrigerant of the ejected refrigerant and the drawn refrigerant into the pressure energy.

Accordingly, the refrigerant passage defined between the inner peripheral surface of the middle body 33 defining the pressure increasing space 30*e* and the lower part of the outer peripheral surface of the passage forming member 35 constitutes a diffuser passage that works as a diffuser (pressure increasing portion) in which the ejected refrigerant and the drawn refrigerant are mixed and the pressure of the mixed refrigerant is increased.

Next, the actuation mechanism 37 located inside the middle body 33 will be described. The actuation mechanism 37 includes a diaphragm 37*a* that is a pressure moved member having a circular thin plate shape. Specifically, the diaphragm 37*a* is fixed by welding, for example, so as to partition a circular column space defined on the outer peripheral side of the middle body 33 into an upper space and a lower space, as shown in FIG. 10.

The upper (flow-in space 30*c* side) space of the two spaces partitioned by the diaphragm 37*a* constitutes an enclosure space 37*b* in which a thermostatic medium whose pressure changes according to a temperature of the refrigerant on the outlet side of the evaporator 14 (the refrigerant flowing out of the evaporator 14). The thermostatic medium whose primary component is the refrigerant circulating in the ejector-type refrigeration cycle 10*a* is enclosed in the enclosure space 37*b* so as to have a predetermined density.

In contrast, the lower space of the two spaces partitioned by the diaphragm 37*a* constitutes an introduction space 37*c* into which the refrigerant on the outlet side of the evaporator 14 is introduced through a communication passage that is not shown. Accordingly, the temperature of the refrigerant on the outlet side of the evaporator 14 is transferred to the thermostatic medium enclosed in the enclosure space 37*c* through the diaphragm 37*a* and a lid member 37*d* that separates the flow-in space 30*c* from the enclosure space 37*b*.

Moreover, the diaphragm 37*a* changes its shape according to a difference between an internal pressure of the enclosure space 37*b* and a pressure of the refrigerant on the outlet side of the evaporator 14 flowing into the introduction space 37*c*. Therefore, the diaphragm 37*a* is preferred to be made of a material that has high elasticity, high thermal conductivity, and high strength. Specifically, a thin metal plate made of stainless (SUS 304) or EPDM (ethylene propylene diene monomer rubber) including a ground fabric may be used as the diaphragm.

At a center part of the diaphragm 37*a*, one end side end portion (upper side end portion) of an actuation bar 37*e* having a circular column shape is bonded. The actuation bar 37*e* transfers an actuation force from the actuation mechanism 37 to the passage forming member 35 to move the passage forming member 35. The other end side end portion (lower side end portion) of the actuation bar 37*e* is located to be in contact with an outer peripheral side of a bottom surface of the passage forming member 35.

As shown in FIG. 10, the bottom surface of the passage forming member 35 receives a stress from a coil spring 40. The coil spring 40 is an elastic member that exerts the stress urging the passage forming member 35 toward an upper side. The upper side is a direction in which the passage forming member 35 decreases the passage cross-sectional area at the smallest passage cross-sectional area portion 25*b*. Accordingly, the passage forming member 35 is moved such that a stress exerted by the high-pressure refrigerant on the swirl space 30*a* side, a stress exerted by the low-pressure refrigerant on the gas-liquid separation space 30*f* side, a stress exerted by the actuation bar 37*e*, and the stress exerted by the coil spring 40 are balanced.

Specifically, when the temperature (degree of superheat) of the refrigerant on the outlet side of the evaporator 14 increases, a saturation pressure of the thermostatic medium enclosed in the enclosure space 37*b* increases, and accordingly the difference between the internal pressure of the enclosure space 37*b* and the pressure of the introduction space 37*c* becomes large. According to this, the diaphragm 37*a* is moved toward the introduction space 37*c* side, and the pressure exerted on the passage forming member 35 by the actuation bar 37*e* increases. Therefore, when the temperature of the refrigerant on the outlet side of the evaporator 14 increases, the passage forming member 35 moves in a direction (downward in the vertical direction) in which the passage cross-sectional area at the smallest passage cross-sectional area portion 25*b* increases.

In contrast, when the temperature (degree of superheat) of the refrigerant on the outlet side of the evaporator 14 decreases, the saturation pressure of the thermostatic medium enclosed in the enclosure space 37*b* decreases, and accordingly the difference between the internal pressure of the enclosure space 37*b* and the pressure of the introduction space 37*c* decreases. According to this, the diaphragm 37*a* moves toward the enclosure space 37*b* side, and the stress exerted on the passage forming member 35 by the actuation bar 37*e* decreases. Therefore, when the temperature of the refrigerant on the outlet side of the evaporator 14 decreases, the passage forming member 35 moves in a direction (upward in the vertical direction) in which the passage cross-sectional area of the smallest passage cross-sectional area portion 25*b* decreases.

In the actuation mechanism 37 of the present embodiment, since the diaphragm 37*a* moves the passage forming member 35 according to the degree of superheat of the refrigerant on the outlet side of the evaporator 14, the passage cross-sectional area at the smallest passage cross-sectional area portion 25*b* is adjusted such that a degree of superheat of the refrigerant on the outlet side of the evaporator 14 comes close to a predetermined reference superheat degree KSH. The reference superheat degree KSH can be changed by adjusting the stress exerted by the coil spring 40.

A gap between the actuation bar 37*e* and the middle body 33 is sealed by a seal member such as O-ring that is not shown, and accordingly the refrigerant does not leak through the gap even when the actuation bar 37*e* moves.

In the present embodiment, multiple (three in the present embodiment) spaces having circular column shape are formed in the middle body 33, and the diaphragm 37*a* having the circular thin plate shape is fixed in each of the spaces to constitute multiple actuation mechanisms 37. Moreover, multiple actuation mechanisms 37 are arranged with regular intervals about the center axis so as to uniformly transfer the actuation force to the passage forming member 35.

Next, the lower body 34 is formed of a metal material having a circular column shape and fixed in the housing body 31 by screwing, for example, so as to close a bottom surface of the housing body 31. The gas-liquid separation space 30*f* that separates the refrigerant flowing out of the diffuser passage defined in the pressure increasing space 30*e* is defined between an upper side of the lower body 34 and the middle body 33.

The gas-liquid separation space 30*f* has a shape of solid of revolution that is approximately circular column shape, and the center axis of the gas-liquid separation space 30*f* is coaxial with the center axes of the swirl space 30*a*, the decompression space 30*b*, and the pressure increasing space 30*e*, for example. In the gas-liquid separation space 30*f*, the refrigerant is separated into the gas-phase refrigerant and the liquid-phase refrigerant by a centrifugal force generated when the refrigerant swirls about the center axis. Moreover, a capacity of the gas-liquid separation space 30*f* is set such that a surplus refrigerant cannot be accumulated substantially even when the amount of the refrigerant circulating in the cycle varies due to a change of load of the cycle.

At a center part of the lower body 34, a pipe 34*a* extending toward the upper side and having a circular cylinder shape is provided coaxially with the gas-liquid separation space 30*f*. The liquid-phase refrigerant separated in the gas-liquid separation space 30*f* is temporarily accumulated on an outer peripheral side of the pipe 34*a* and flows through the liquid-phase refrigerant outlet 31*c*. In the pipe 34*a*, a gas-phase refrigerant outlet passage 34*b* through which the gas-phase refrigerant separated in the gas-liquid separation space 30*f* is guided to the gas-phase refrigerant outlet 31*d* of the housing body 31 is provided.

The above-described coil spring 40 is fixed on an upper end portion of the pipe 34*a*. The coil spring 40 works as a vibration absorbing member that reduces a vibration of the passage forming member 35 due to a pulse of the pressure generated when the refrigerant is decompressed. Moreover, an oil return hole 34*c* through which a refrigeration oil is returned to the compressor 11 through the gas-phase refrigerant outlet passage 34*b* is formed in the bottom surface of the gas-liquid separation space 30*f*.

Accordingly, the ejector 25 of the present embodiment includes: the swirl space 30*a* generating a swirl flow in the refrigerant flowing through the refrigerant inlet 31*a*; the decompression space 30*b* decompressing the refrigerant flowing out of the swirl space 30*a*; the passage for drawing the refrigerant (flow-in space 30*c*, suction passage 30*d*) communicating with the refrigerant downstream side of the decompression space 30*b* to flow the refrigerant drawn from outside; and the body 30 including the pressure increasing space 30*e* in which the ejected refrigerant jetted from the decompression space 30*b* and the drawn refrigerant drawn through the passage for drawing 30*c*, 30*d* are mixed. The ejector 25 includes: the passage forming member 35 at least a part of which is located in the decompression space 30*b* and the pressure increasing space 30*e*, the passage forming member 35 having a circular cone shape in which the cross-sectional area increases from the decompression space 30*b*; and the actuation device 37 that outputs a driving force moving the passage forming member 35. The refrigerant passage defined between the inner peripheral surface of a part of the body 30 defining the decompression space 30*b* and the outer peripheral surface of the passage forming member 35 is the nozzle passage 25*a* that works as a nozzle from which the refrigerant flowing through the refrigerant inlet 31*a* is decompressed and jetted. The refrigerant passage defined between the inner peripheral surface of the body 30 defining the pressure increasing space 30*e* and the outer peripheral surface of the passage forming member 35 is the diffuser passage that works as the pressure increasing portion in which the ejected refrigerant and the drawn refrigerant are mixed, the pressure of the mixed refrigerant is increased in the diffuser passage. The nozzle passage 25*a* includes: the smallest passage cross-sectional area portion 25*b* at which the passage cross-sectional area is at the minimum; the convergent portion 25*c* defined on the refrigerant upstream side of the smallest passage cross-sectional area portion 25*b*, the passage cross-sectional area in the convergent portion 25*c* is gradually decreased toward the smallest passage cross-sectional area portion 25*b*; and the divergent portion 25*d* defined on the refrigerant downstream side of the smallest passage cross-sectional area portion 25*b*, the passage cross-sectional area in the divergent portion 25*d* is gradually increased.

Moreover, when the actuation device 37 moves the passage forming member 35, a part of the passage forming member 35 of the ejector 25 which changes the passage cross-sectional area of the smallest passage cross-sectional area portion 25*b* is the tip portion 35*a*. When the passage forming member 35 moves in a direction in which the passage cross-sectional area of the smallest passage cross-sectional area portion 25*b* is increased, the amount of displacement of the passage forming member 35 is the positive displacement amount δ. The tip portion 35*a* has a shape in which the increase rate of the passage cross-sectional area of the smallest passage cross-sectional area portion 25*b* is increased according to the increase of the positive displacement amount δ.

The other configurations of the ejector-type refrigeration cycle 10*a* are the same as the ejector-type refrigeration cycle 10 of the first embodiment. The ejector 25 of the present embodiment is a device in which multiple components constituting the cycle are integrated with each other. Accordingly, when the ejector-type refrigeration cycle 10*a* of the present embodiment is operated, it works in the same way as the ejector-type refrigeration cycle 10 of the first embodiment, and the same effects can be obtained.

Moreover, in the ejector 25 of the present embodiment, since the swirl space 30*a* that is a swirl flow generation portion is provided, high energy conversion efficiency can be obtained similarly to the first embodiment by swirling the refrigerant in the swirl space 30*a* during the low-load operation and the middle-load operation of the ejector-type refrigeration cycle 10*a*.

In the ejector 25 of the present embodiment, the tip portion 35*a* of the passage forming member 35 has a shape in which the increase rate of the passage cross-sectional area of the smallest passage cross-sectional area portion 25*b* increases according to the increase of the positive displacement amount δ. Accordingly, the passage cross-sectional area of the smallest passage cross-sectional area portion 20*b* can be increased such that coefficient of discharge does not decrease similarly to the first embodiment by increasing the positive displacement amount δ during the high-load operation of the ejector-type refrigeration cycle 10.

Consequently, also in the ejector 25 of the present embodiment, the increase of the pressure loss occurring when the refrigerant flows through the nozzle passage 20*a* during the high-load operation can be limited, and large decrease of coefficient of discharge during the high-load operation can be limited.

The present disclosure is not limited to the above-described embodiments, and it is to be noted that various changes and modifications will become apparent to those skilled in the art.

Figure 12:
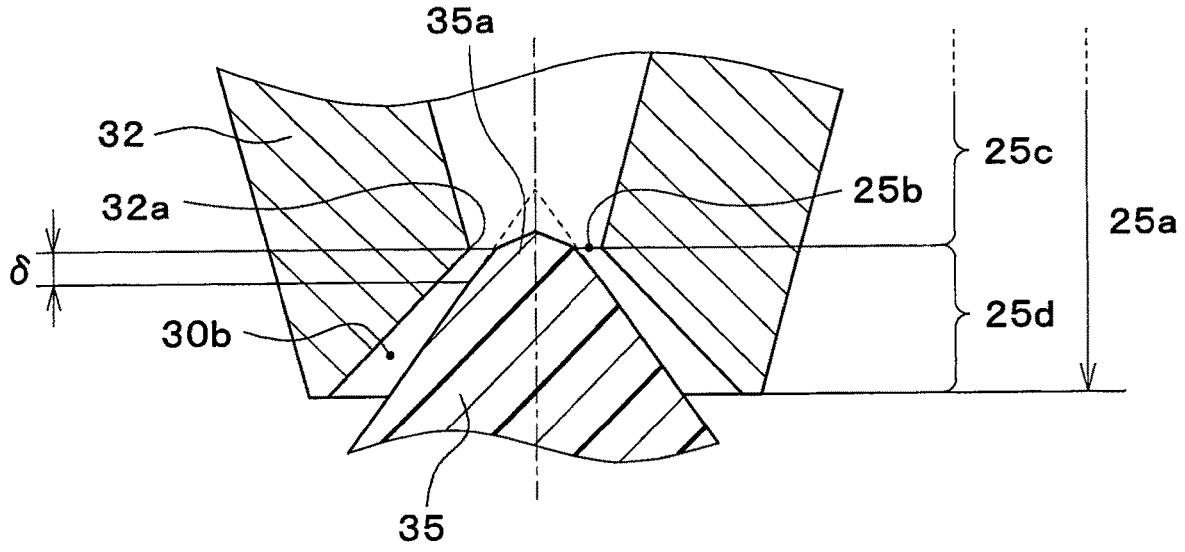
FIG. 12 is a diagram illustrating an enlarged tip portion according to another embodiment and corresponds to FIG. 11.

(1) In the above-described embodiments, examples where the tip of the tip portion 23*b*, 35*a* is shaped in a hemisphere shape are described, but the shape is not limited to these examples. For example, as shown in FIG. 12, the shape may be a combination of multiple circular cone shapes and conical frustum shapes whose angle of the tip are different from each other. In the shape formed by the combination, the increase rate of the passage cross-sectional area of the smallest passage cross-sectional area portion 20*b* increases according to the increase of the positive displacement amount δ.

When the tip portion 35*a* shown in FIG. 12 is employed, the increase rate of the smallest passage cross-sectional area portion 25*b* increases in a step-by-step manner according to the increase of the positive displacement amount δ.

(2) The components constituting the ejector-type refrigeration cycle 10 are not limited to the above-described embodiments.

For example, in the above-described embodiments, an electric compressor is used as the compressor 11. However, an engine-driving type compressor which is driven by a rotational driving force transferred from an engine for vehicle travel through a pulley or a belt may be used as the compressor 11. Moreover, as the engine-driving type compressor, a capacity changeable compressor that is capable of changing a refrigerant discharge capacity according to a change of a required discharge amount, or a fixed capacity compressor that adjusts a refrigerant discharge amount by changing an operation rate of the compressor via intermitting an operation of an electromagnetic clutch can be employed.

In the above-described embodiments, a subcooling-type heat exchanger is used as the radiator 12, but an ordinary radiator that includes only the condensing portion 12*a* may be employed. Moreover, a receiver-integrated type condenser in which a liquid receiver (receiver) is integrated with the radiator may be employed. The liquid receiver separates the refrigerant that has dissipated heat in the radiator into a gas-phase refrigerant and a liquid-phase refrigerant and accumulates a surplus liquid-phase refrigerant.

Furthermore, in the above-described embodiment, it is described that R123a, R1234yf or the like can be employed as the refrigerant, but the refrigerant is not limited to this. For example, R600a, R410A, R404A, R32, R1234yfxf, R407C or the like may be employed. Moreover, a mix refrigerant in which some of these refrigerants are mixed may be employed.

(3) In the above-described embodiments, an example where the ejector-type refrigeration cycle 10 according to the present disclosure is used in the vehicular air conditioning device is described, but the usage of the ejector-type refrigeration cycle 10 is not limited to this. For example, the ejector-type refrigeration cycle 10 may be used in a stationary-type air conditioning device, a cooling temperature storage, a cooling-heating device for a vending machine or the like.

(4) In the above-described embodiments, the radiator 12 of the ejector-type refrigeration cycle 10 of the present disclosure is used as an outside heat exchanger that performs heat exchange between the refrigerant and the outside air, and the evaporator 14 is used as a usage side heat exchanger that cools the blown air. However, a heat pump cycle in which: the evaporator 14 may be used as the outside heat exchanger that absorbs heat from a heat source such as an outside air; and the radiator 12 may be used as an interior heat exchanger that heats a heating target fluid such as air or water, can be constituted.

Although the present disclosure has been described in connection with the preferred embodiments thereof, it is to be noted that various changes and modifications will become apparent to those skilled in the art. The present disclosure includes various changes and modifications within the equivalent. Moreover, other combinations and configurations, including more, less or only a single element, are also within the spirit and scope of the present disclosure.

The invention claimed is:

1. An ejector for a vapor-compression refrigeration cycle device, the ejector comprising:

a nozzle that ejects a refrigerant;

a swirl flow generation portion that generates a swirl flow about a center axis of the nozzle in the refrigerant flowing into the nozzle;

a body that includes a refrigerant suction port, the refrigerant being drawn from an outside through the refrigerant suction port due to a drawing effect of the ejected refrigerant ejected from the nozzle, and a pressure increasing portion in which the ejected refrigerant and the drawn refrigerant drawn through the refrigerant suction port are mixed, a pressure of the mixed refrigerant being increased in the pressure increasing portion;

a passage forming member that is inserted into a refrigerant passage defined in the nozzle; and an actuation device that is a motor or a diaphragm moving the passage forming member, wherein a nozzle passage is defined between an inner peripheral surface of the nozzle and an outer peripheral surface of the passage forming member, the nozzle passage being a refrigerant passage that decompresses the refrigerant, the nozzle passage includes a smallest passage cross-sectional area portion at which a cross-sectional area of the nozzle passage is at a minimum, a convergent portion that is located upstream of the smallest passage cross-sectional area portion with respect to a refrigerant flow, the cross-sectional area of the nozzle passage in the convergent portion gradually decreasing toward the smallest passage cross-sectional area portion, and a divergent portion that is located downstream of the smallest passage cross-sectional area portion with respect to the refrigerant flow, the cross-sectional area of the nozzle passage in the divergent portion gradually increasing from the smallest passage cross-sectional area portion, the passage forming member includes a tip portion which changes the cross-sectional area of the nozzle passage at the smallest passage cross-sectional area portion when the actuation device moves the passage forming member, a positive displacement amount is defined as an amount of a displacement of the passage forming member when the passage forming member is moved so as to increase the passage cross-sectional area at the smallest passage cross-sectional area portion, the tip portion has a shape in which an increase rate of the passage cross-sectional area at the smallest passage cross-sectional area portion increases according to an increase of the positive displacement amount, the tip portion includes a conical portion that has a conical shape and includes a vertex of the tip portion, a truncated conical portion that has a truncated conical shape and is directly connected to the conical portion, and an apex angle of the conical portion is larger than an apex angle of the truncated conical portion, the actuation device is configured to move the passage forming member to have a first state and a second state so that the truncated conical portion overlaps with the smallest passage cross-sectional area portion in a direction perpendicular to an axial direction of the passage forming member during the first state of the passage forming member, and the conical portion overlaps with the smallest passage cross-sectional area portion in the direction perpendicular to the axial direction during the second state of the passage forming member, and when the passage forming member is moved to increase the passage cross-sectional area at the smallest passage cross-sectional area portion, the increase rate of the passage cross-sectional area during the second state of the passage forming member is greater than the increase rate of the passage cross-sectional area during the first state of the passage forming member.

2. The ejector according to claim 1, wherein the actuation device moves the passage forming member so as to increase a flow rate of the refrigerant flowing through the nozzle passage according to an increase of a thermal load of the refrigeration cycle device, and the increase rate of the passage cross-sectional area at the smallest passage cross-sectional area portion is increased according to an increase of the flow rate.

3. An ejector refrigeration cycle comprising:

the ejector according to claim 1; and a radiator that cools a high-pressure refrigerant discharged from a compressor compressing the refrigerant such that the high-pressure refrigerant becomes a subcooled liquid-phase refrigerant, wherein the subcooled liquid-phase refrigerant flows into the swirl flow generation portion.

* * * * *